US007473868B2

(12) United States Patent
Bohan, Jr. et al.

(10) Patent No.: US 7,473,868 B2
(45) Date of Patent: Jan. 6, 2009

(54) FAIL SAFE HVAC TEMPERATURE AND MEDIUM PRESENCE SENSOR

(75) Inventors: John E. Bohan, Jr., Avon Lake, OH (US); John P. Graham, Elyria, OH (US); Christopher A. Fildes, Grafton, OH (US)

(73) Assignee: R. W. Beckett Corporation, North Ridgeville, OH (US)

( * ) Notice: Subject to any disclaimer, the term of this patent is extended or adjusted under 35 U.S.C. 154(b) by 588 days.

(21) Appl. No.: 11/172,055

(22) Filed: Jun. 30, 2005

(65) Prior Publication Data

US 2007/0000908 A1 Jan. 4, 2007

(51) Int. Cl.
*H05B 1/02* (2006.01)

(52) U.S. Cl. ..... 219/505; 219/504; 219/497; 219/506; 219/487; 236/1 C; 236/91 D; 236/91 F

(58) Field of Classification Search ..... 219/491, 219/497, 501, 505, 504, 508, 487, 506; 236/1 R, 236/1 C, 91 R, 91 D
See application file for complete search history.

(56) References Cited

U.S. PATENT DOCUMENTS 4,340,355 A 7/1982 Nelson et al.
4,637,745 A 1/1987 Speisebecher et al.
4,933,833 A 6/1990 Petroff
5,175,565 A 12/1992 Ishinaga et al.
5,197,329 A 3/1993 Grundy
5,801,940 A * 9/1998 Russ et al. ..... 700/9
6,588,882 B2 7/2003 Silverbrook
6,649,881 B2 * 11/2003 Scott et al. ..... 219/492
7,275,863 B1 * 10/2007 Akers et al. ..... 374/102
2005/0096644 A1 * 5/2005 Hall et al. ..... 606/41

* cited by examiner

*Primary Examiner*—Mark H Paschall
(74) *Attorney, Agent, or Firm*—Eschweiler & Associates, LLC

(57) ABSTRACT

A system and method is presented for a fail-safe sensor for an HVAC system. The sensor comprises a temperature detector operable to measure a temperature of a component or a medium present at the sensor, a PTC heater operable to heat the sensor to a self-regulating temperature, the heater comprising a resistive element having an electrical impedance which increases with increasing temperature in accordance with a positive temperature coefficient characteristic, and a sensor housing comprising the PTC heater and the temperature detector provided within a single housing. An algorithm is provided for HVAC systems, wherein the sensor is heated to the self-regulating temperature by the PTC heater and is then measured by the temperature detector to confirm that the temperature detector is operating properly. Further, the sensor may be allowed to cool to a temperature of the surrounding medium or the component for sensing the temperature thereof. Thereafter, by calculating the time constant of the thermal decay rate of the sensor, the presence or absence of the component or medium surrounding the sensor may be determined in a fail-safe manner by an analyzer, for example.

60 Claims, 14 Drawing Sheets

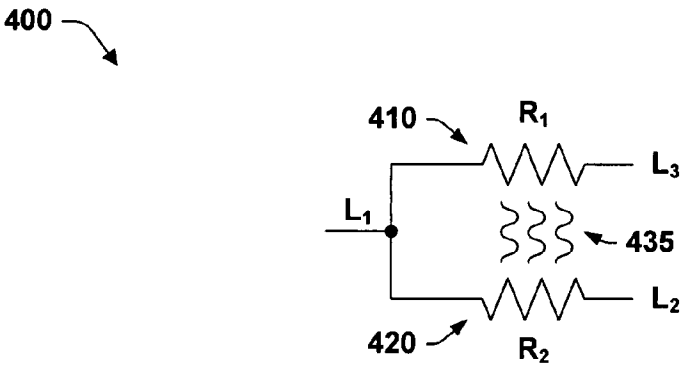
FIG. 4A
FIG. 4B
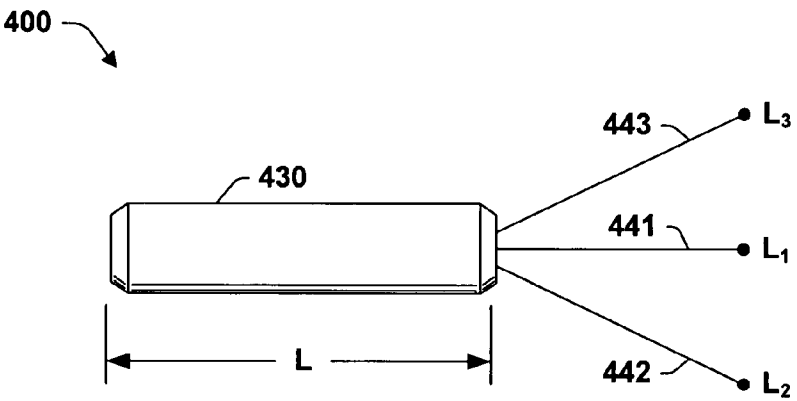
FIG. 4C

FAIL SAFE HVAC TEMPERATURE AND MEDIUM PRESENCE SENSOR

FIELD OF INVENTION

The present invention relates generally to sensors and more particularly to sensor systems and algorithms that operate in a fail-safe manner to detect the temperature of a component or a medium and/or to detect the presence thereof within a heating, ventilating, or air-conditioning (HVAC) system.

BACKGROUND OF THE INVENTION

Heating systems employ various methods to control the temperature of components with the system. The temperatures of these components are usually regulated within a particular range in order to maintain safe operation. Two such components that require regulation are heat exchangers of furnaces and the water inside a pressurized hot water boiler. Redundant sensors are often used in safety-related components such as these, which provide greater confidence that the sensors are operating properly. Two or more such sensors may reduce the probability of the heating control system recognizing an incorrect temperature, however, the proper functionality of the additional sensors are not known with any greater confidence than the initial sensor.

Temperature measurement is important in many such processes. A common method of temperature measurement uses thermocouple transducers that output an EMF in response to a temperature gradient across two dissimilar materials, typically metals. It is well known, however, that thermocouples degrade over time due to chemical and metallurgical changes in the composition of the materials. Various thermal sensors and detectors such as thermistors, platinum resistance elements, and other types of temperature sensors are also utilized in many heating, ventilation, and air-conditioning (HVAC) applications.

Most temperature sensors used in these HVAC applications, whether used in industrial, commercial, or residential markets, eventually suffer from some form of serious degradation and/or failure of the sensor. Such degradation or failure modes of temperature detectors include thermal degradation, metal fatigue, corrosion, chemical and mechanical changes, which may render the sensor inoperable or otherwise induce a system failure.

During the use of thermocouples, for example, several forms of degradation take place in the thermocouple circuit including chemical, metallurgical, and mechanical changes in the materials and elements or devices of the circuit. Such changes may be accompanied by a shift in the resistivity of the thermoelement, thereby indicating a false temperature measurement.

Heating applications likely produce the greatest potential for sensor failures, where the sensor is particularly susceptible to extremes of thermal degradation and chemical changes. These sensors may include temperature, pressure, flow, and medium presence sensors, and others such as may be used in furnaces and boilers. The exposed portion of the sensor is often the hottest portion of the measurement circuit and may therefore be exposed to the harshest conditions. The temperature sensor and other related sensors are also exposed to processes that may increase the likelihood of changes in the electrical properties of the sensor or cause a complete system failure.

In boiler applications, for example, temperature, pressure, flow, and medium presence detection may be used, wherein the failure of a temperature sensor or an associated low-water level cutoff detector may cause a boiler malfunction or failure. Thus, the failure of such boiler sensors poses a problem. In furnace applications, the temperature sensors and/or limit detectors used in a heat exchanger of a furnace may also reach very high temperatures, and cause overheating conditions that could cause the system to fail. Accordingly, a fail-safe temperature sensor and/or a fail-safe low-water level cut-off detector would be desirable to avoid such problems.

For design, manufacturing, and applications reasons, the HVAC sensors discussed above are generally individually fabricated, packaged and mounted. However, the use of these numerous individual sensors also requires more system mounting difficulties and added complexity in support of the remaining portion of the control system. Such additional support components and circuitry may include related relays, power supplies, and microprocessors that increase the overall cost and complexity of the system.

In many applications, however, several specific sensors are commonly used together. For example, in the case of boiler heating systems, a boiler water temperature sensor is usually accompanied by a low-water cutoff detector, which senses the presence of the water (or another such medium) when strategically placed at the low water level of the boiler. If the water falls below this level, the system is typically shut-down until more water is added, thereby immersing the sensor again.

Accordingly, for fail-safe temperature readings, cost, mounting and system simplicity reasons, there is a need for a fail-safe sensor of a temperature monitoring system that incorporates both temperature and medium detection functions in a single housing.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

The present invention is directed to a fail-safe sensor system and method for detecting a temperature and/or the presence of a component or a medium within an HVAC system in a fail-safe manner. The fail-safe sensor of the present invention comprises a positive temperature coefficient (PTC) resistance element or PTC heater that regulates itself at a known temperature when supplied power. The sensor further comprises a temperature detector (e.g., PTC or NTC thermistor, thermocouple, IC temperature detector) in close thermal proximity to the PTC heater provided within a single sensor housing.

In one method aspect of the present invention, when heated to the self-regulating temperature, the temperature signal of the temperature detector is compared with the known regulated temperature of the PTC heater to confirm whether the sensor is presenting an accurate signal to an analyzer or control system. The device is then allowed to cool to the temperature of the surrounding medium in the component it is designed to sense. The temperature of the component is then measured with greater confidence than would otherwise be provided with a single sensing device or multiple sensing devices.

In another aspect of the present invention, by calculating the time constant of the temperature decay rate of the sensor, a determination is made whether a component or a medium surrounding the sensor is present or absent, for example, whether the sensor is immersed in water or air. In one implementation, for example, a slower decay time constant indicates the sensor is in air, while a faster decay time constant indicates the sensor is immersed in water. Knowledge of the presence of water is important, because boilers may become damaged when fired without water. Thus, the sensor of the present invention eliminates the need for separate and relatively costly medium presence detection (e.g., low-water cut-off) devices and controls (e.g., related relays, power supplies, and microprocessors) currently used in conventional HVAC systems.

In another implementation of the present invention, the sensor is used to measure the temperature of a heat exchanger, an outlet plenum, an air stream, a chamber wall, a stack, or other component, for example, in a furnace or another HVAC system. In such a case, the time constant of the temperature decay rate is used to indicate whether the sensor has adequate thermal contact with the furnace component or has become loose or separated from the furnace component.

In yet another aspect of the invention, the HVAC system may be a furnace, a boiler, a ventilation system, a refrigeration system, or an air-conditioning system.

In still another aspect of the invention, the PTC heater and the temperature detector each have first and second electrical terminals, and are electrically joined together at the first electrical terminals to form a three terminal device.

In another aspect, the PTC heater and the temperature detector are prefabricated on a single integrated circuit die, a single ceramic substrate, or another such common thermal platform.

In yet another aspect of the invention, the sensor housing also has a thermally conductive and electrically insulative material formed about the PTC heater and the temperature detector to provide a close thermal union between the elements of the sensor.

Detecting the temperature or presence of other solids or liquids surrounding the sensor is also anticipated in the context of the systems and methods of the present invention.

A detection system of the present invention monitors the resistance of a temperature detector while alternately heating and cooling a PTC heater to identify the regulation temperature and calculate the thermal time constant of a component or a medium surrounding a sensor in an HVAC system, thereby providing a determination of the health of the sensor and/or the presence or absence of the medium.

In one aspect of the present invention, the PTC heater also serves as the temperature detector when the heater element is not being heated to provide both heater and detector functions within a single element of the sensor.

The present invention further provides an algorithm for HVAC systems to identify a temperature, a low medium alarm, and a failed sensor alarm in a sensor measurement circuit. For example, the algorithm, according to one aspect of the invention, utilizes one or more values supplied by the manufacturer of the sensor and one or more predetermined thermal time constant (TC) levels for comparison to the calculated TC levels, whereby the presence or absence of the medium is determined based on the comparison results.

For example, a first predetermined (cool-down) TC level is initially input into the analyzer for use by the algorithm corresponding to a medium (e.g., water) present at a low water level cut-off location of the sensor. If a determination is made upon comparison that the computed TC level has exceeded the first predetermined TC level, the medium is present at the sensor, however, if the first predetermined TC level is not exceeded, the medium is absent from the sensor, and a low-water cut-off alarm is generated. If the computed TC has not exceeded a second predetermined (cool-down) TC level, or if a third predetermined (warm-up) TC level is not exceeded, a sensor maintenance alarm may be generated.

Thus, by applying parameters specific to the temperature detector and PTC heater of a sensor used in a monitoring system, added accuracy is obtained in determining the TC level for the applicable medium used in the HVAC system using the algorithms of the present invention. Further, it is anticipated that the algorithms used in the methods and temperature monitoring system of the present invention may be used to identify degradation of the sensor in order to predict a future potential sensor system failure therein.

The temperature monitoring system of the present invention comprises a temperature sensor, a storage component, and an analyzer comprising an algorithm for identifying a temperature, a low medium alarm, a sensor alarm, and optionally for predicting certain types of impending failures of the temperature sensor or the HVAC system. The analyzer of the monitoring system is operable to receive sensor parametric input values available from the sensor, monitor one or more sensors (e.g., thermistor, thermocouple) inputs, monitor the temperature detector resistance of the sensor, supply or remove a voltage (e.g., from a power supply) to the PTC heater of the sensor for heating or cooling the sensor, and calculate and store the parameters and predetermined TC levels in the storage component. In response, the analyzer may then provide one or more of a temperature detection, a low medium alarm, a sensor alarm, and a failure prediction based on an analysis of the sensor (temperature detector) (e.g., resistance) measurement results from the algorithm.

For example, the detection system may, according to one aspect of the invention, monitor the resistance of a sensor for changes that are analyzed and determined to be due to a level of sensor degradation greater than a predetermined acceptable level. Although only the sensor resistance need be monitored, an accurate determination may be made using the algorithm and several parameters of the temperature detector from the manufacturer.

In accordance with another aspect of the invention, by creating a time-series history of periodic sensor TC level calculations, a prediction of an imminent sensor or HVAC system failure, or a prediction of a next expected value may be provided by the monitoring system.

To the accomplishment of the foregoing and related ends, the following description and annexed drawings set forth in detail certain illustrative aspects and implementations of the invention. These are indicative of but a few of the various ways in which the principles of the invention may be employed. Other aspects, advantages and novel features of the invention will become apparent from the following detailed description of the invention when considered in conjunction with the drawings.

BRIEF DESCRIPTION OF THE DRAWINGS

FIGS. 4A-4C illustrate a schematic diagram, end and side views, respectively, of an exemplary fail-safe sensor used in accordance with an aspect of the present invention, the sensor having both a PTC heater and a temperature detector provided within a single housing, such as may be used to monitor the temperature and the presence of water in a hot water boiler system;

DETAILED DESCRIPTION OF THE INVENTION

Figure 1:
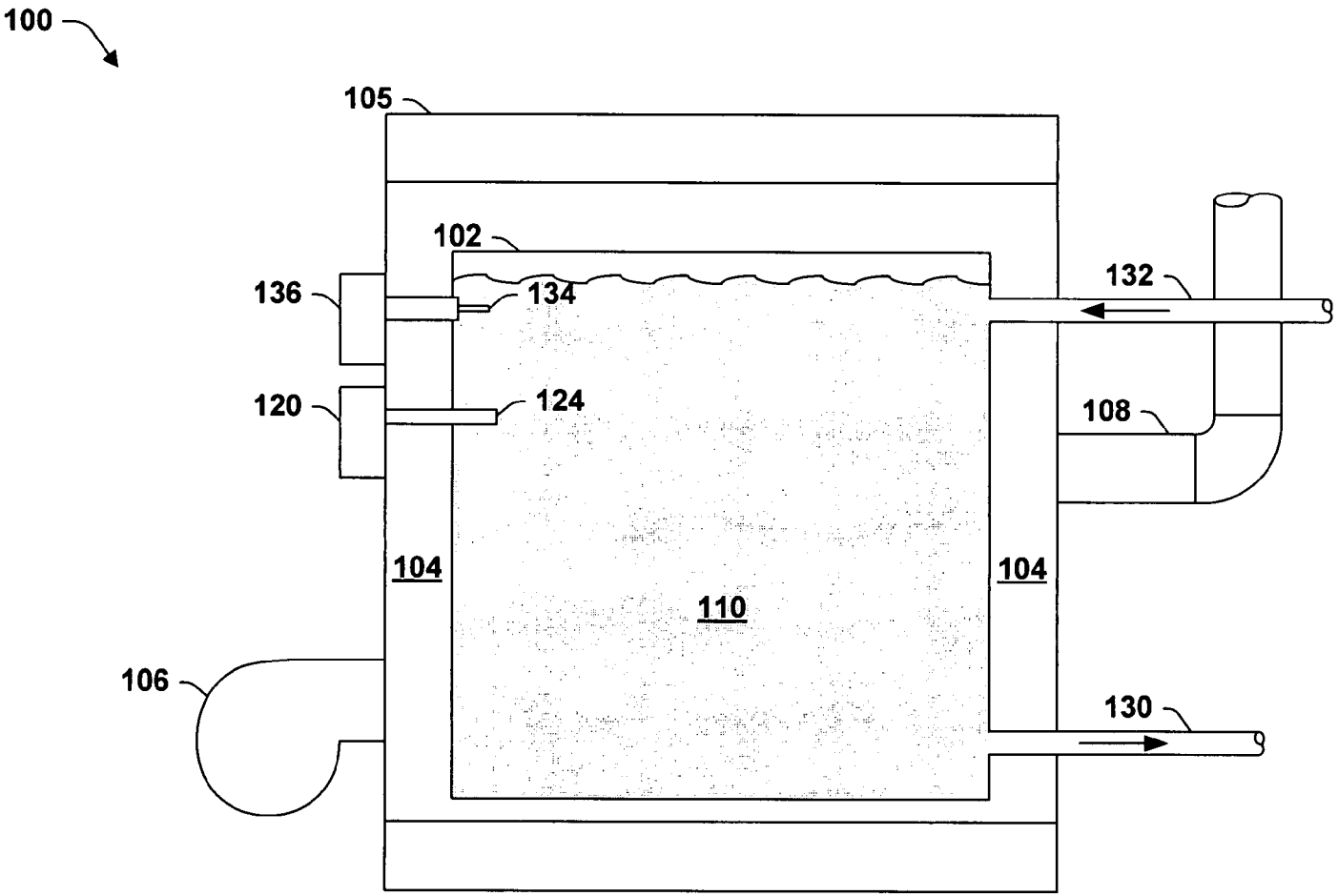
FIG. 1 PRIOR ART
FIG. 1 is a simplified diagram of a prior art hot water boiler system using a separate conventional temperature sensor for measuring the temperature of the water, and a low-water cut-off detector used to detect the presence of water in the boiler.

The present invention will now be described with reference to the attached drawings, wherein like reference numerals are used to refer to like elements throughout. The invention relates to a fail-safe sensor system and method for detecting a temperature and/or the presence of a component or a medium within a heating, ventilating, and air-conditioning or HVAC system in a fail-safe manner. The fail-safe sensor of the present invention incorporates the functions of a heater and a temperature detector within a single sensor housing. In one aspect of the invention, the fail-safe sensor of the present invention comprises a positive temperature coefficient (PTC) resistance element or PTC heater that regulates itself at a known or self-regulating temperature when supplied power. In one implementation, the sensor further comprises a temperature detector (e.g., PTC or NTC thermistor, thermocouple, IC temperature detector) in close thermal proximity to the PTC heater provided within a single sensor housing. Alternately, the PTC heater may also serve as the temperature detector when the heater element is not being heated.

When used in a hot water boiler application, a goal of the fail-safe sensor of the present invention is to combine the functions of a temperature detector and a low-water cut-off device within a single sensor. Conventionally, these functions typically require the use of separate devices, which add system complexity as well as cost for the added supporting components (e.g., relays, power supplies, microprocessors, housings, wiring) and for the individual device mounting costs.

Fail-safe operation is obtained by providing the sensor the ability to confirm that the temperature detector is working properly. To accomplish this, in one aspect of the present invention, an algorithm is provided which is used to monitor the health of the sensor and to detect a component or medium in contact with the sensor. When heated to the self-regulating temperature, the temperature signal of the temperature detector is compared with the known regulated temperature of the PTC heater to confirm whether the sensor is presenting an accurate signal to an analyzer or a control system. The sensor is then allowed to cool to the temperature of the surrounding medium in the component it is designed to sense. The temperature of the component is then measured with greater confidence than that which may be provided with a single sensing device or multiple sensing devices.

Initial parameters of the specific thermoelements used in the sensor may be supplied by the manufacturer or otherwise ascertained in another manner. These parameters may be useful for increasing the accuracy of the temperature measurements. In addition, inputting one or more predetermined acceptable levels of thermal decay rate time constants may be useful for identification of specific medium densities or for sensor degradation levels and failure predictions. In order to better appreciate one or more features of the invention, several exemplary implementations of the temperature and presence detection system, the temperature and presence detection method, and several types of system outputs is hereinafter illustrated and described with respect to the following figures.

FIG. 1 illustrates a prior art hot water boiler system 100, wherein a conventional temperature sensing control device is used for measuring and controlling the boiler based on the temperature of the water, and a separate conventional low-water cut-off detector is used to detect the presence of water in the boiler for safe operation thereof. Numerous types of common temperature sensing devices or sensors are utilized in such HVAC systems, including those based on thermocouples, thermistors, and fluid filled copper bulbs to help regulate the temperature and level of water within the boiler.

The conventional boiler 100 of FIG. 1, comprises a boiler tank 102 surrounded by an insulating material layer 104 within a boiler enclosure 105. A burner 106 having a flue vent 108, heats water 110 within the tank 102 to a temperature set by a temperature sensing control device 120. The temperature sensing control device 120 has, for example, a fluid filled copper bulb 124, which expands when heated to actuate a high/low limit module for control of the system about a temperature set point. The heated water 110 is circulated through a feed water line 130 to an external heat exchanger (not shown) and the cooled water returns to the boiler through a supply/return line 132. If the level of the water 110 within the boiler tank 102 drops below the level of a live probe 134 of a low-water cut-off device 136, the burner 106 is shut-down until further water 110 is added to the boiler 100 to maintain safe operation by avoiding boiler damage.

Figure 2:
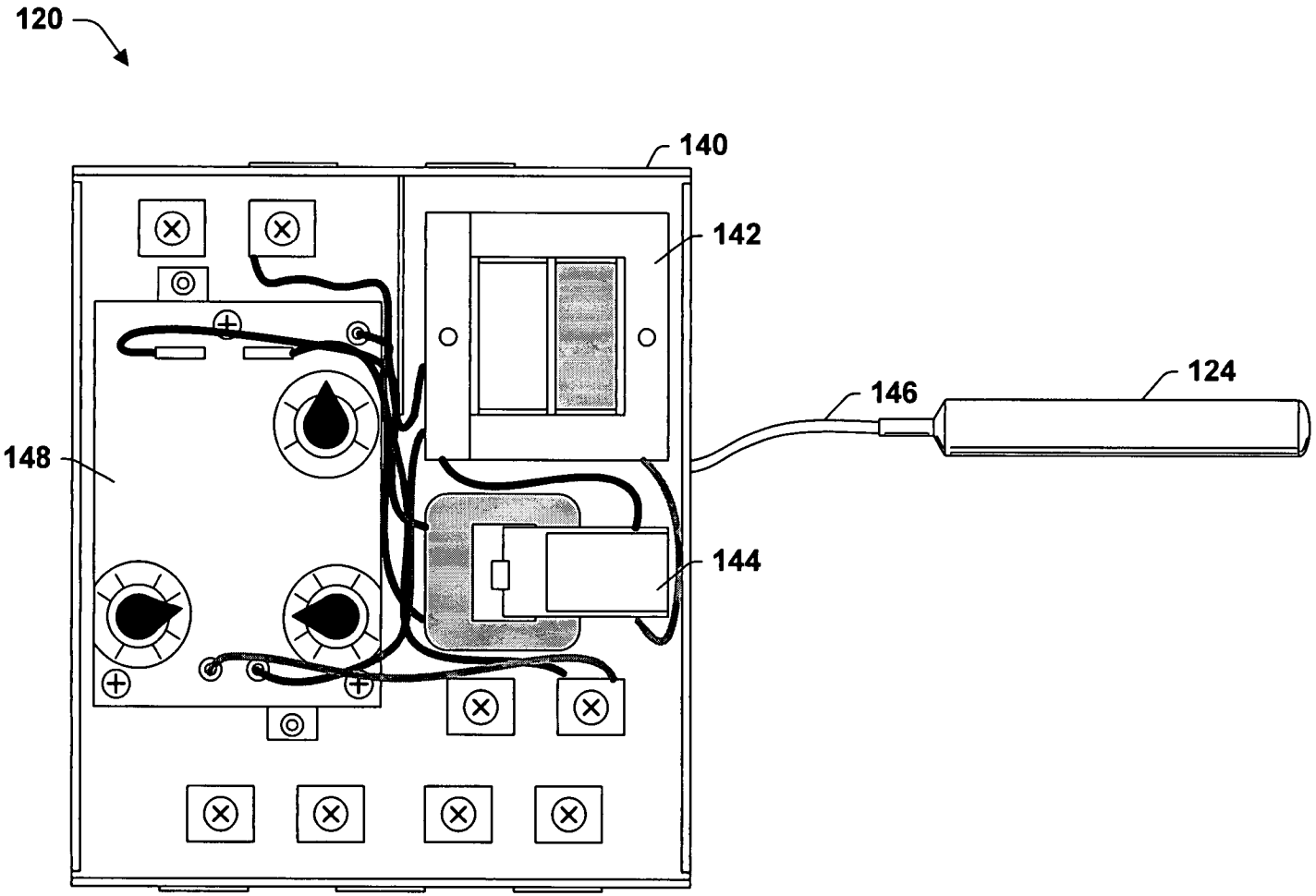
FIG. 2 PRIOR ART
FIG. 2 is a prior art diagram illustrating a conventional temperature sensing control device such as may be used in the prior art boiler system of FIG. 1.

FIG. 2 illustrates a prior art temperature sensing control device 120 such as may be used in the prior art boiler system 100 of FIG. 1. The temperature sensing control device 120 comprises a control housing 140 containing a transformer 142 that supplies power to a room thermostat (not shown), which closes to energize a relay 144. The fluid filled copper bulb 124 is inserted into a well or opening within the boiler tank 102. When the boiler temperature increases, for example, the liquid expands thru copper tubing 146, pushing against a diaphragm that actuates (opens/closes) contacts within a high/low limit module 148. If the thermostat is calling for heat (contacts closed), the relay 144 turns the burner 106 on, if the boiler 100 water temperature is not overheated. Relay 144 also turns on a water circulator (not shown) if the water is warm enough. The limit module 148 will also turn on the burner 106 if the boiler temperature gets too cold. Such temperature sensing control devices 120 may include an electronic sensor, processors, and relays in place of the liquid filled bulb 124 type temperature sensor.

Figures 3A, 3B:
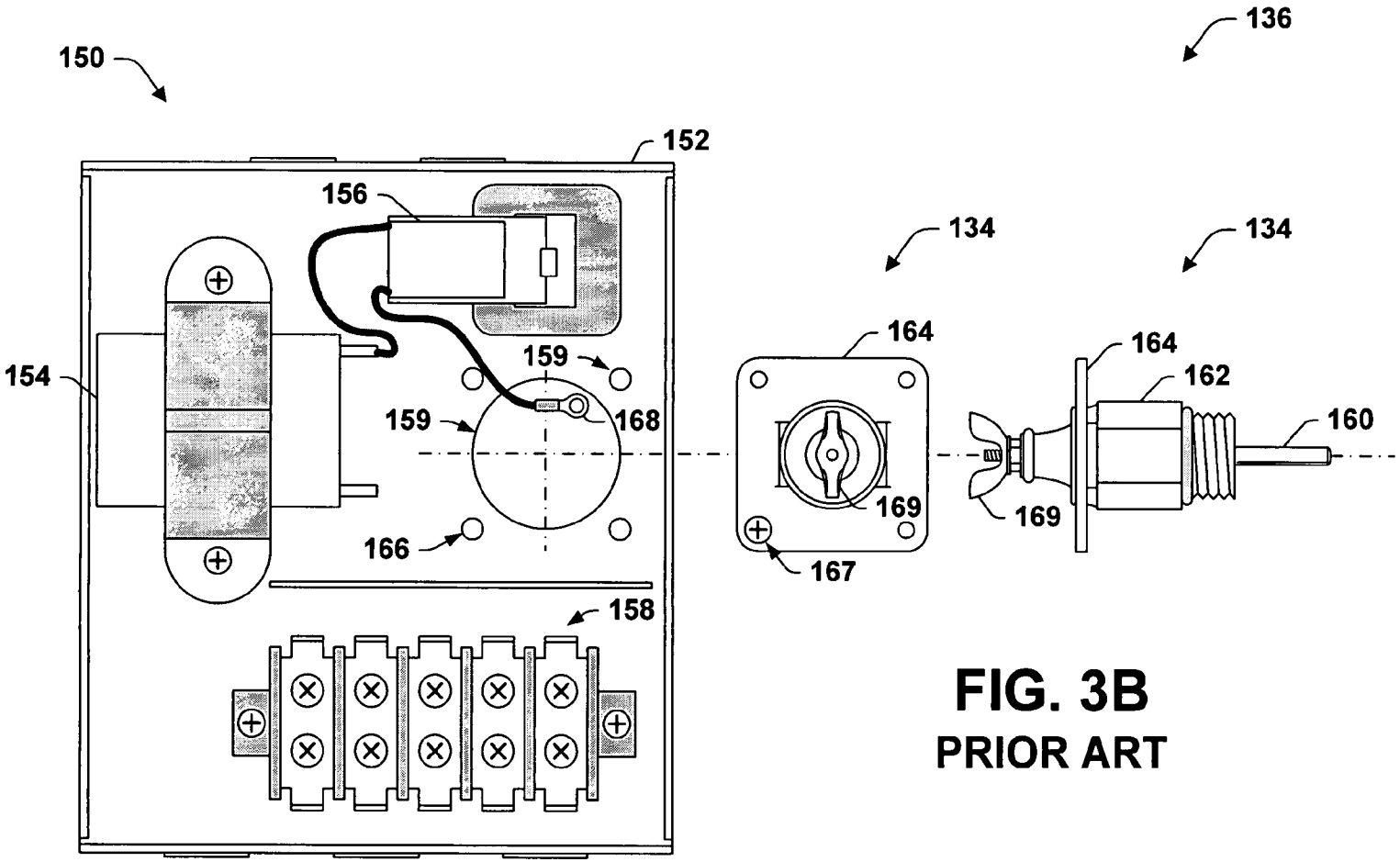
FIG. 3B PRIOR ART
FIG. 3A PRIOR ART
FIGS. 3A and 3B are prior art diagrams illustrating a conventional low-water cut-off device having a controller and sensor, respectively, such as may be used in the prior art hot water boiler system of FIG. 1.

FIGS. 3A and 3B illustrate an exemplary conventional low-water cut-off device 136 having a controller 150 and a live probe sensor 134, respectively, such as may be used in the prior art hot water boiler system 100 of FIG. 1.

The low-water cut-off controller 150 of FIG. 3A comprises a control housing 152 containing a control transformer 154, a control relay 156, a wiring terminal strip 158, and an access/mounting holes 159 for the live probe 134. The live probe 134 of FIG. 3B comprises a conductive probe 160 insulated within a metal body 162 attached to a mounting plate 164. The mounting plate 164 of the live probe 134 is brought to a ground potential at 166, by affixing the mounting plate 164 within the control housing 152, inserting the probe 134 within a separate boiler well or opening (as in FIG. 1), and attachment of ground screws 167. A wire 168 from the coil of the relay 156 connects to the wing nut 169 on a threaded portion of the conductive probe 160. For clarity, not all wires are shown in the controller 150.

In operation, transformer 154 supplies voltage through the coil of the relay 156 to the live conductive probe 160, which is mounted into the boiler 100 and insulated from equipment ground 166. If there is water 110 in the boiler 100, current will flow through the coil of relay 156 and the live probe 134 through the water 110 to ground 166, pulling in the relay 156 and passing line voltage power (e.g., 120VAC) to the burner 106.

Thus, in the conventional boiler system configuration 100, separate water temperature sensing and water presence detection may be required for operation in a safe manner. Accordingly, added device, and related equipment costs, including added mounting costs are typically needed in a prior art system.

FIGS. 4A-4C illustrate a schematic diagram, and end and side views, respectively, of an exemplary fail-safe sensor 400 in accordance with an aspect of the present invention. The sensor 400 comprises both a temperature detector R1, 410 (e.g., PTC or NTC thermistor, thermocouple, or integrated circuit detector) and a PTC heater R2, 420 (e.g., a PTC thermistor, including the detector R1 itself, or an integrated circuit heater) provided within a single sensor housing 430 (e.g., silicon rubber casting, thermal epoxy potting, or a metal or plastic sleeve), such as may be used to monitor the temperature and the presence of water in a hot water boiler system 500 as will be discussed further in association with FIG. 5 infra.

The particular arrangement of the sensor 400 of the present invention permits the temperature detector 410 to sense the surrounding temperature, while the PTC heater 420 provides heating 435 to the sensor 400 and self-regulation at a known temperature. Measurement using the temperature detector 410 at the known temperature set by the PTC heater 420 then provides a level of confidence that the operation of the temperature detector 410 is providing an accurate temperature measurement. In addition, as indicated supra, when power is removed from the heater 420, the time constant (TC) of the thermal decay rate may be computed (e.g, by an analyzer) from two or more temperature measurements, to indicate whether a component or medium (e.g., a heat sink, heat exchanger, water) is present surrounding the sensor, or is absent. For example, a high TC temperature decay rate may indicate the sensor is immersed in water (medium present), while a low TC rate may indicate the sensor is in air (medium absent).

Further, the sensor housing 430 of FIGS. 4B and 4C may also comprise a separate sleeve (e.g., a metal or plastic sleeve) with the detector element 410 and the heater element 420 cast or potted together therein, for example, with silicon rubber, thermal epoxy, or a ceramic material) to provide a close thermal union between the two elements. The close thermal union between the two elements provides a quick and more accurate thermal response therebetween and to the surrounding environment or medium. The detector element 410 and the heater element 420, in one example, each have two electrical terminals, for example, which may be wired in parallel to provide a single three terminal device 400, having leadwires L1 441, L2 442, and L3 443, as illustrated in FIG. 4C.

A thermally conductive paste may be applied to the inside of the boiler well so that when the sensor is inserted, there is a good thermal connection. In one preferred implementation, however, the temperature detector 410 and the PTC heater 420 are cast together in a silicon rubber housing 430 that may be inserted into the boiler well with no such thermal paste. Then when a cap (not shown), for example, is screwed down at the opening of the well, it compresses the sensor slightly to cause the sensor to widen and fill the gap between it and the well, creating a good thermal connection. Alternately, in another preferred implementation, a thermal contact side or wet side of the sensor is mounted thru an opening in the boiler wall to directly contact the boiler water, thereby inherently providing intimate thermal contact with the medium.

In another implementation of the present invention, the temperature detector R1 410 and the heater R2 420 may be fabricated together on a single integrated circuit chip or another such common substrate such as silicon or ceramic for both temperature detection and heating/cooling of the elements of the sensor 400. It is a goal in one aspect of the present invention to minimize the distance and maximize the thermal union between the temperature detector 410 and the heater 420. It is another goal in one aspect of the present invention to minimize the mass of the detector 410 and the heater 420. In these ways, the responsiveness of the sensor to the surrounding medium, and to each other of the elements therein may be maximized.

Figure 4D:
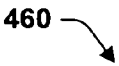
FIGS. 4D-4F illustrate a schematic diagram, end and side views, respectively, of an exemplary fail-safe sensor used in accordance with an aspect of the present invention, the sensor having a PTC heater used as a combination heater and a temperature detector provided within a single housing, such as may be used to monitor the temperature and the presence of water in a hot water boiler system.
Figure 4D:
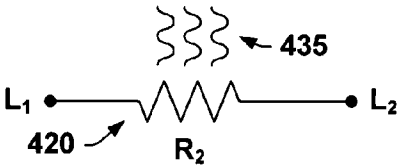
Figure 4E:
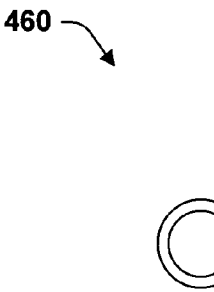
Figure 4F:
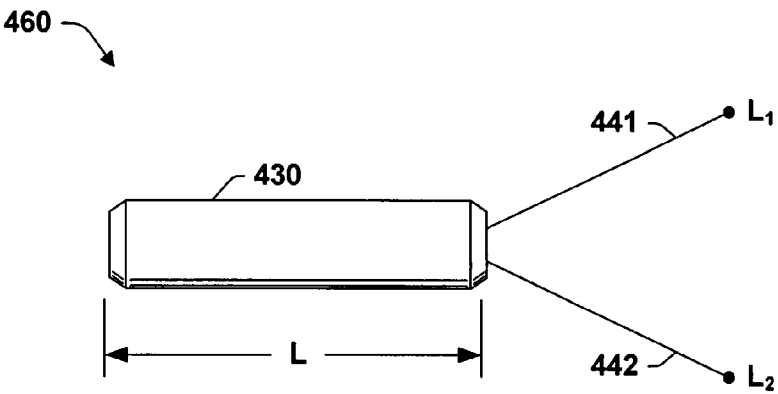

FIGS. 4D-4F illustrate a schematic diagram, and end and side views, respectively, of an exemplary fail-safe sensor 460 used in accordance with another aspect of the present invention. Sensor 460 is similar to sensor 400 of FIGS. 4A-4C, but only has one element, and as such need not be completely described again for the sake of brevity. Sensor 460 comprises a PTC heater R2, 420 (e.g., a PTC thermistor, and an integrated circuit heater) used as a combination heater and temperature detector provided within a single housing 430 (e.g., silicon rubber casting, thermal epoxy potting, or a metal or plastic sleeve), such as may be used to monitor the temperature and the presence of water in a hot water boiler system 500 as will be discussed further in association with FIG. 5 infra.

In this implementation of sensor 460, the PTC heater 420 provides the heat 435 within the sensor 460 when power is applied to the heater 420. Then, when power is removed from the heater 420 of sensor 460, the PTC resistive element of the heater 420 is also used as a temperature detector similar to that of temperature detector 410 of FIGS. 4A-4C.

The difference between the two exemplary sensor implementations 400 and 460 is in the method of temperature detection. In sensor 460, the temperature detector confidence check at the known regulation temperature of PTC heater 420, for example, may be made immediately after removing the heater power supply, and before the sensor has had a chance to cool significantly. However, the time constant of sensor 460 may be too quick (short) to make an accurate measurement practical after power removal. Alternately, therefore, the current and voltage going into sensor 460 may both be monitored and the resistance calculated during the heating phase to provide continuous temperature monitoring from the resistance calculation. Thus, using either sensor 400 or 460, the known regulation temperature may be maintained at a stable temperature level while monitoring the temperature measurement is being obtained.

Although a single temperature detector and heater is discussed in association with the sensor of the present invention, the use of one or more temperature detectors and/or heaters may be used within the sensor, and is anticipated in accordance with the invention.

Figure 4G:
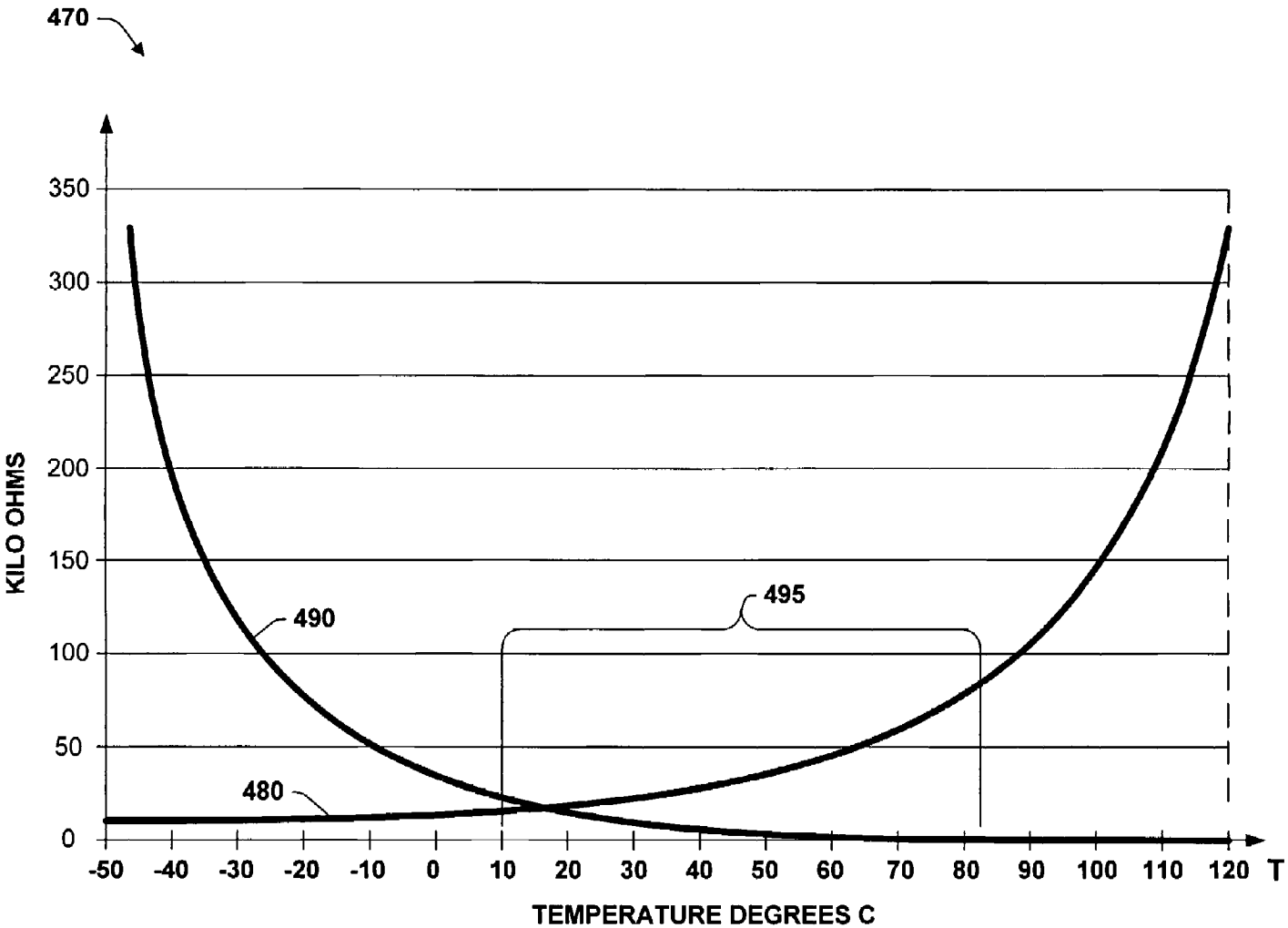
FIG. 4G is a plot of an exemplary PTC resistive element exhibiting an increasing change in resistance as the temperature increases such as may be used in a PTC heater or temperature sensor, and an NTC resistive element exhibiting a decreasing change in resistance as the temperature increases such as may be used in an NTC temperature sensor, respectively, in accordance with one or more aspects of the present invention.

FIG. 4G illustrates a plot 470 of an exemplary PTC resistive element 480 exhibiting an increasing change in resistance as the temperature (T) increases such as may be used in a PTC heater 420 or temperature sensor 410, and an NTC resistive element 490 exhibiting a decreasing change in resistance as the temperature increases such as may be used in an NTC temperature sensor 410, respectively, in accordance with one or more aspects of the present invention. If the temperature detector 410 is separate from the PTC heater 420 as in fail-safe sensor 400 of FIGS. 4A-4C, the temperature detector 410 may utilize, for example, the NTC type detector element 490, otherwise, the PTC type element 480 is preferred in accordance with the present invention, to provide the self-regulation feature of a PTC type heater. A typical operating range 495 for a hot water boiler system is also illustrated ranging from about 10° C. to about 82° C. (about 50-180° F.).

Figure 5:
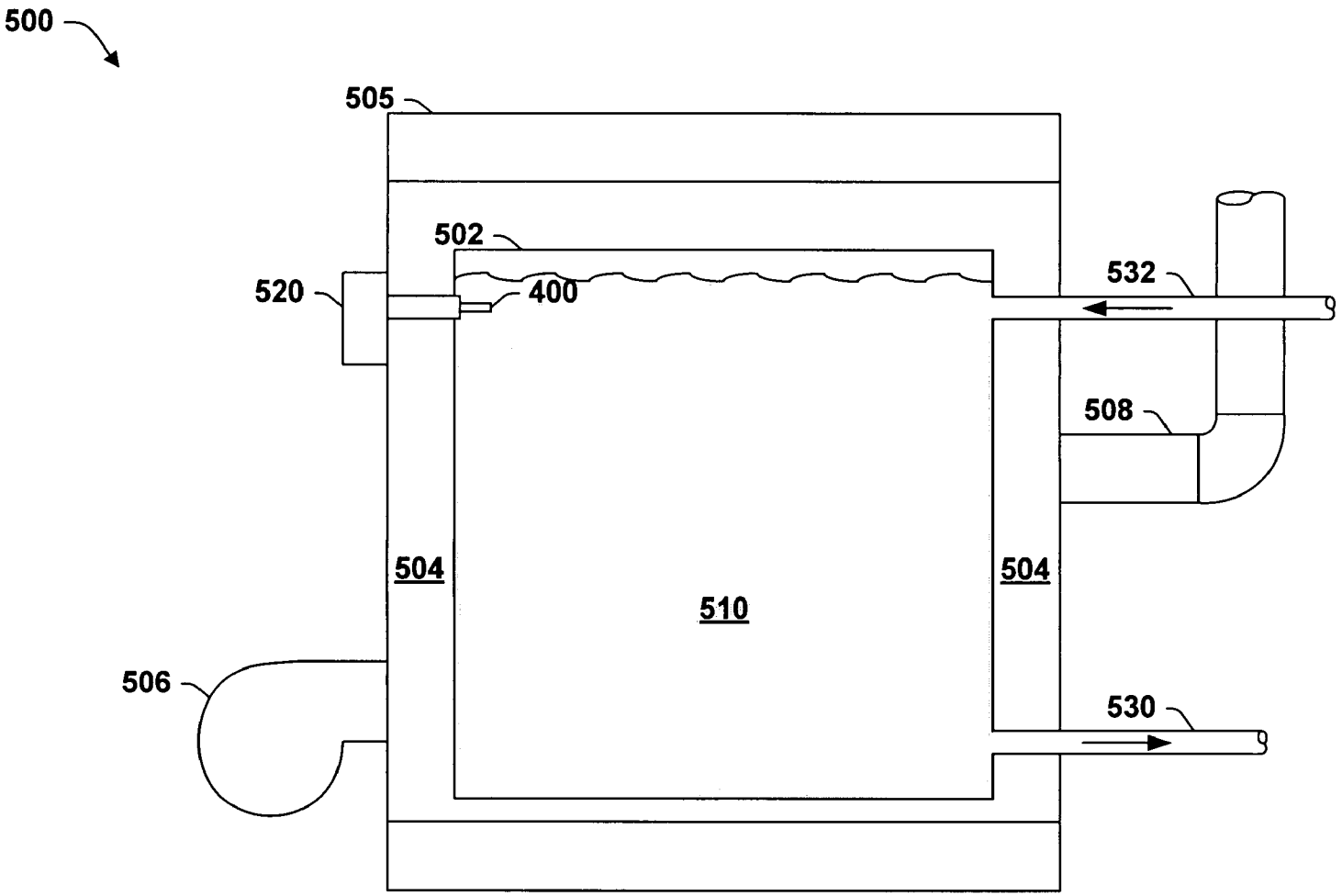
FIG. 5 is a simplified diagram of an exemplary hot water boiler system using a single fail-safe sensor for measuring a temperature of the water and for detecting the presence of the water in the boiler, the functions provided together in a single fail-safe temperature sensor.

FIG. 5 illustrates an exemplary hot water boiler system 500, utilizing a single fail-safe sensor similar to that of 400 and 460 of FIGS. 4A-4F, for measuring both a temperature and detecting the presence of the water in the boiler 500 in a fail-safe manner in accordance with the present invention. Other such HVAC systems may also incorporate the fail-safe sensor of the present invention to help regulate the temperature and level of other medium (e.g, water, Freon, ammonia, or alcohol) used in the HVAC system.

The exemplary boiler 500 of FIG. 5, comprises a boiler tank 502 surrounded by an insulating material layer 504 within a boiler enclosure 505. A burner 506, having a flue vent 508, heats water 510 within the tank 502 to a temperature set by a temperature and presence sensing control device 520. The temperature and presence sensing control device 520 has a fail-safe sensor 400 (e.g., or 460), having a temperature detector element 410 that changes in resistance when heated to actuate a high/low limit temperature monitoring circuit or another such analyzer (not shown) for control of the system about a temperature set point. The heated water 510 is circulated through a feed water line 530 to an external heat exchanger (not shown) and the cooled water returns to the boiler through a supply/return line 532. If the level of the water 510 within the boiler tank 502 drops below the level of the fail-safe sensor 400 of the temperature and presence sensing control device 520, the burner 506 is shut-down until further water 510 is added to the boiler 500 to maintain safe operation by avoiding boiler damage.

The fail-safe sensor 400 of the temperature and presence sensing control device 520 also has a PTC heater 420 that is used to cyclically heat and cool the sensor 400. As the sensor 400 cools in each thermal cycle, the change in temperature is monitored by the analyzer using the change in resistance of the temperature detector 410. From the temperature measurements, the analyzer then computes the thermal decay rate time constant (TC) of the sensor 400, to determine whether water 510 is present surrounding the sensor 400. If water 510 is not present at the sensor 400 (indicating a low water condition), the burner 506 is shut-down until additional water 510 is added, thereby maintaining fail-safe operation of the boiler system 500. Further, the health of the sensor 400 may also be ascertained by using the temperature detector 410 to monitor the PTC heater 420 within the sensor 400, after thermal equilibrium is established at the known self-regulation temperature. Thus, in accordance with several aspects of the present invention, the fail-safe sensor 400 may be used to detect the temperature and presence of a medium in an HVAC system in a fail-safe manner.

In another implementation of the present invention, the temperature and presence of a heat exchanger (not shown) may be detected using the sensor 400 and 460 of the present invention. As a heat exchanger (e.g., comprising a high thermal conductivity metal with fins) is likely to produce a higher thermal decay rate than that of water or another such medium, the temperature swing produced by the PTC heater 420 of the sensor 400/460, is also likely to be low. Thus, the known self-regulation temperature of the PTC heater 420 may be shifted to a significantly lower temperature level when used in the determination of health of the temperature detector 410. Further, the presence detection algorithm as it may be applied to a heat exchanger application, may be somewhat limited to determining whether there is adequate thermal union between the sensor 400/460 and the heat exchanger. For example, if the sensor 400/460 has slipped out of the heat exchanger, the thermal TC would be greatly reduced and a presence determination therefore would indicate that the medium (e.g., heat exchanger) is not present.

Figure 6A:
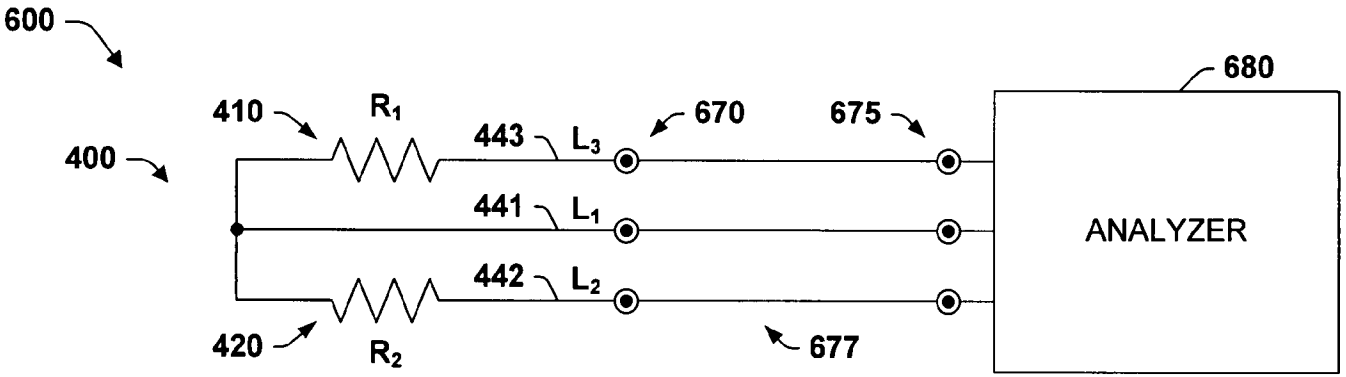
FIG. 6A is a simplified schematic diagram of an equivalent circuit of an exemplary fail-safe temperature and presence monitoring system of the present invention using the fail-safe sensor of FIGS. 4A-4C in accordance with an aspect of the present invention.
Figure 6B:
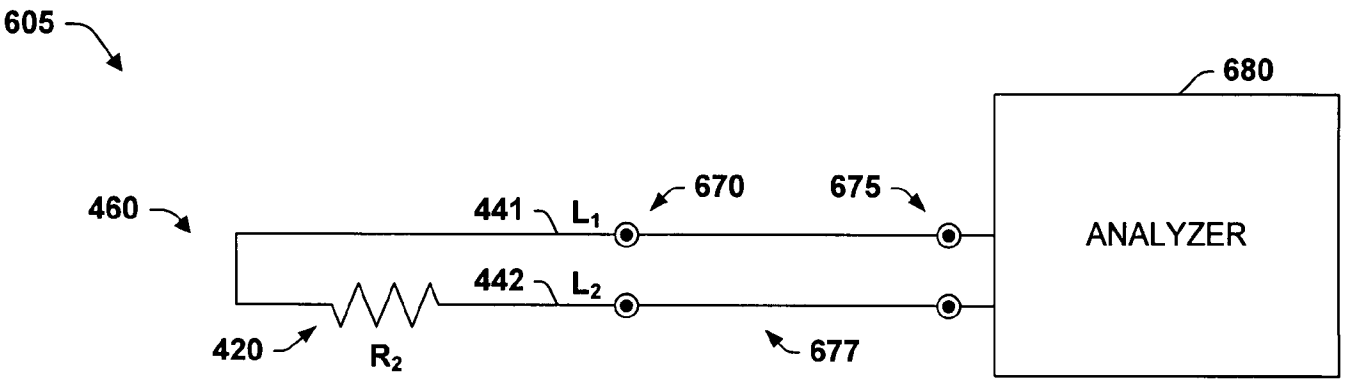
FIG. 6B is a simplified schematic diagram of an equivalent circuit of another exemplary fail-safe temperature and presence monitoring system of the present invention using the fail-safe sensor of FIGS. 4D-4F in accordance with another aspect of the present invention.

FIG. 6A illustrates an equivalent circuit of an exemplary fail-safe temperature and presence monitoring system 600 of the present invention using the fail-safe sensor 400 of FIGS. 4A-4C. Similarly, FIG. 6B illustrates an equivalent circuit of another exemplary fail-safe temperature and presence monitoring system 605 of the present invention using the fail-safe sensor 460 of FIGS. 4D-4F. Both of the systems 600 and 605, comprise a PTC heater R2, 420 in the sensor 400 and 460 respectively, however, only sensor 400 of system 600 comprises a second temperature detection element R1, 410. As indicated in association with the discussion of FIGS. 4D-4F, however, sensor 460 utilizes the PTC heater 420 as a combination heater and temperature detector within the single PTC resistive element 420. In this case, the temperature detection capability is available when the heater power supply is removed.

Lead wires L1 441, L2 442, and L3 443 may transition at field terminals 670 to field wiring 677, which connects to local terminals 675 of an analyzer 680 for monitoring the fail-safe sensor 400/460. As discussed in association with FIG. 5, the analyzer 680 of FIGS. 6A and 6B is operable to monitor the resistance measurements of the temperature detector 410 or the PTC element 420, respectively, and provide associated temperatures. Then, using the resistance measurements or the temperatures, the analyzer is further operable to compute the thermal decay rate time constant (TC) of the sensor 400/460 to determine whether a medium or a component is present at the sensor 400/460. Further, the health of the sensor 400/460 may also be ascertained with the assistance of the analyzer 680, by monitoring the temperature detector 410 or the PTC element 420, and comparing the temperature indicated to the temperature of the PTC heater 420 after thermal equilibrium is established at the known self-regulation temperature.

Figure 7A:
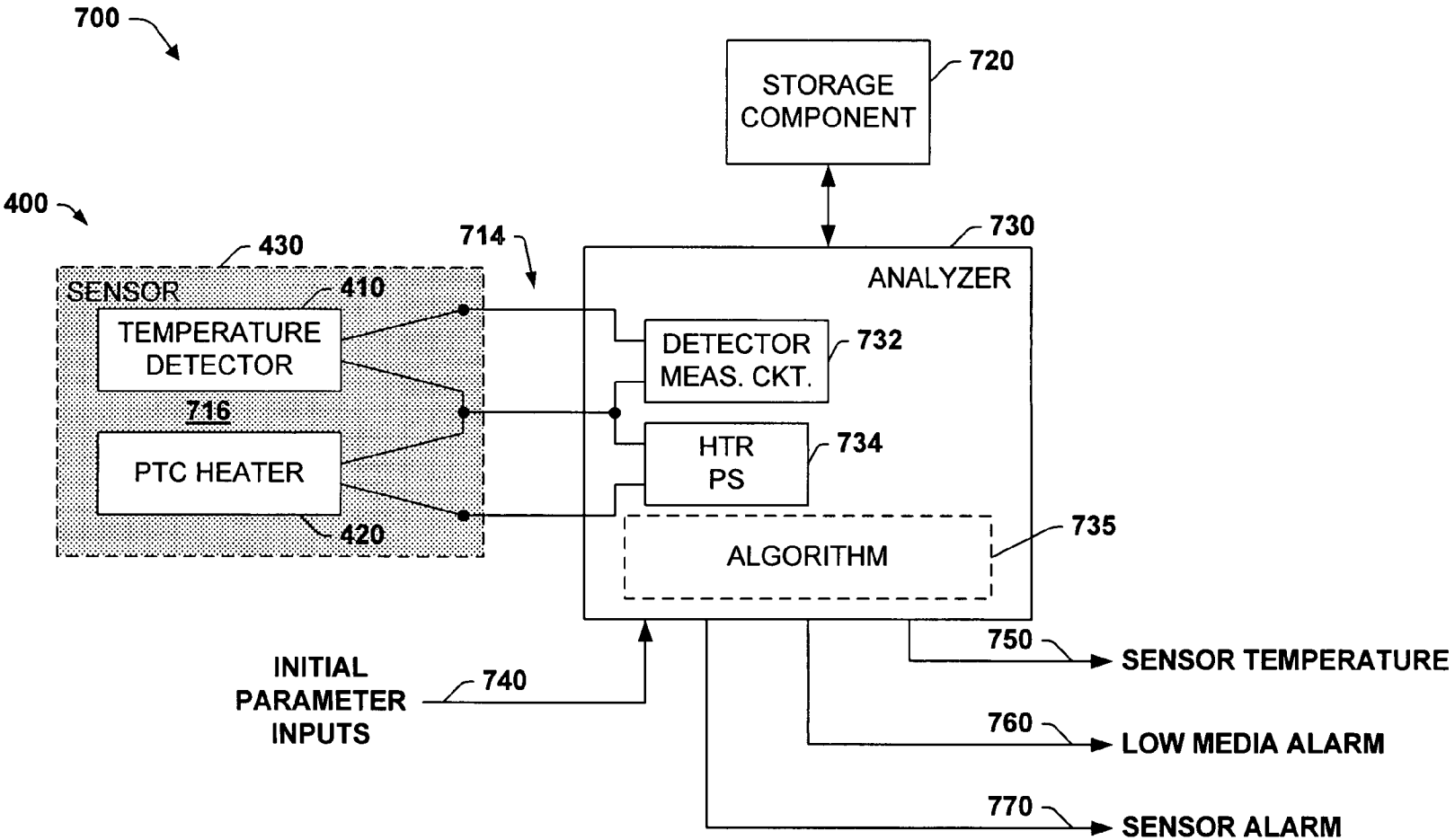
FIG. 7A is a simplified block diagram of an exemplary fail-safe temperature and presence monitoring system for measuring a temperature and/or for detecting the presence of a medium, and for detecting sensor degradations and predicting failures in accordance with an aspect of the present invention using the fail-safe sensor of FIGS. 4A-4C.
Figure 7B:
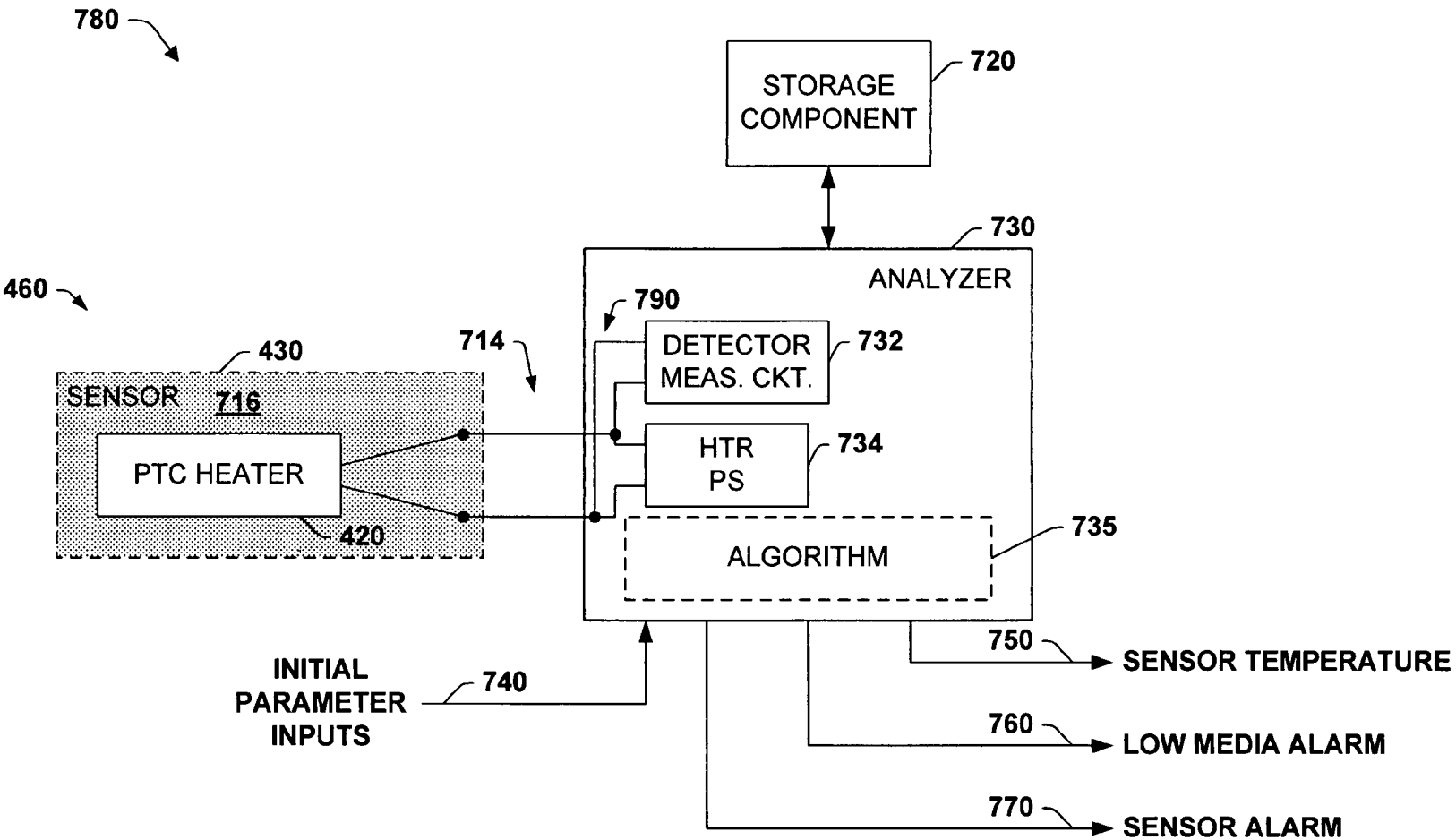
FIG. 7B is a simplified block diagram of another exemplary fail-safe temperature and presence monitoring system for measuring a temperature and/or for detecting the presence of a medium, and for detecting sensor degradations and predicting failures in accordance with an aspect of the present invention using the fail-safe sensor of FIGS. 4D-4F.

FIGS. 7A and 7B illustrate further details of an exemplary fail-safe temperature and presence monitoring system 700 and 780, respectively, for measuring a temperature and/or for detecting the presence of a medium, and for detecting sensor degradations and predicting failures in accordance with an aspect of the present invention using the fail-safe sensor 400 of FIGS. 4A-4C and 460 of FIGS. 4D-4F, respectively. Again, the sensor 400/460 of FIGS. 7A and 7B, respectively, comprises a sensor housing 430 having, for example, a separate outer sleeve (e.g., a metal or plastic sleeve). The sensor 400/460 of FIGS. 7A and 7B further comprises the detector element 410 and the heater element 420 affixed together within a casting or potting material 716 (e.g., silicon rubber, thermal epoxy, or ceramic material) to provide a close thermal union between the two elements.

For example, system 700 of FIGS. 7A and 780 of FIG. 7B both comprise a fail-safe sensor 400 or 460, respectively, connected to an analyzer 730 (e.g., microprocessor, computer, PLC). The analyzer 730 is further operably coupled to a storage component 720 (e.g., memory) for storage of initial input parameters 740 (e.g., initial resistance of the detector at a certain temperature, PTC known self-regulation temperature, low medium alarm levels or acceptable TC levels for the presence of a component or medium, acceptable sensor degradation % levels). Analyzer 730 further comprises a detector measurement circuit 732 for monitoring the temperature of the temperature detector 410 of system 700 or the PTC heater 420 (acting as the temperature detector) of system 780. Analyzer 730 also includes a controllable heater power supply 734 (e.g., 12VDC, 120VAC) to supply a voltage to the PTC heater 420 (e.g., PTC thermistor, integrated circuit heater) for heating the sensor 400/460 to a known self-regulation temperature.

Analyzer 730 further comprises an algorithm 735 (e.g., a program, a computer readable media, a hardware state machine) that is applied to the system to calculate and analyze the temperature monitoring, presence detection, and/or sensor degradation and failure prediction. Upon completion of such calculations and/or analysis, the algorithm 735 provides several possible output results from the analyzer 730 that may include a current sensor temperature 750 (e.g., 180° F.), and if a predetermined limit has been achieved, a low medium alarm 760 (e.g., low-water cut-off level, medium absent), and/or a sensor alarm 770 (e.g., sensor or system failure imminent, sensor maintenance required) may be issued.

Similar to system 605 of FIG. 6B, in system 780 of FIG. 7B, the temperature detection capability of sensor 430 is available when the heater power supply 734 is removed from the PTC heater 420. Thus, in system 780, the heater power supply 734 is operable to be coupled and uncoupled from the detector measurement circuit 732 and the heater 420.

Alternately, and as indicated previously, the current and voltage going into sensor 460 may both be monitored and the resistance calculated during the heating phase to provide continuous temperature monitoring based on the resistance calculation.

In another implementation of the present invention, the sensor may comprise an integrated circuit heater and/or detector further operable, for example, to digitally communicate to the analyzer a temperature signal, a sensor parametric input, a sensor model, a sensor serial number, a manufacturing date, and a calibration temperature. Further, the Integrated circuit based sensor, may be operable to provide one or more of the output determination results that are discussed above in association with the analyzer.

Figure 8:
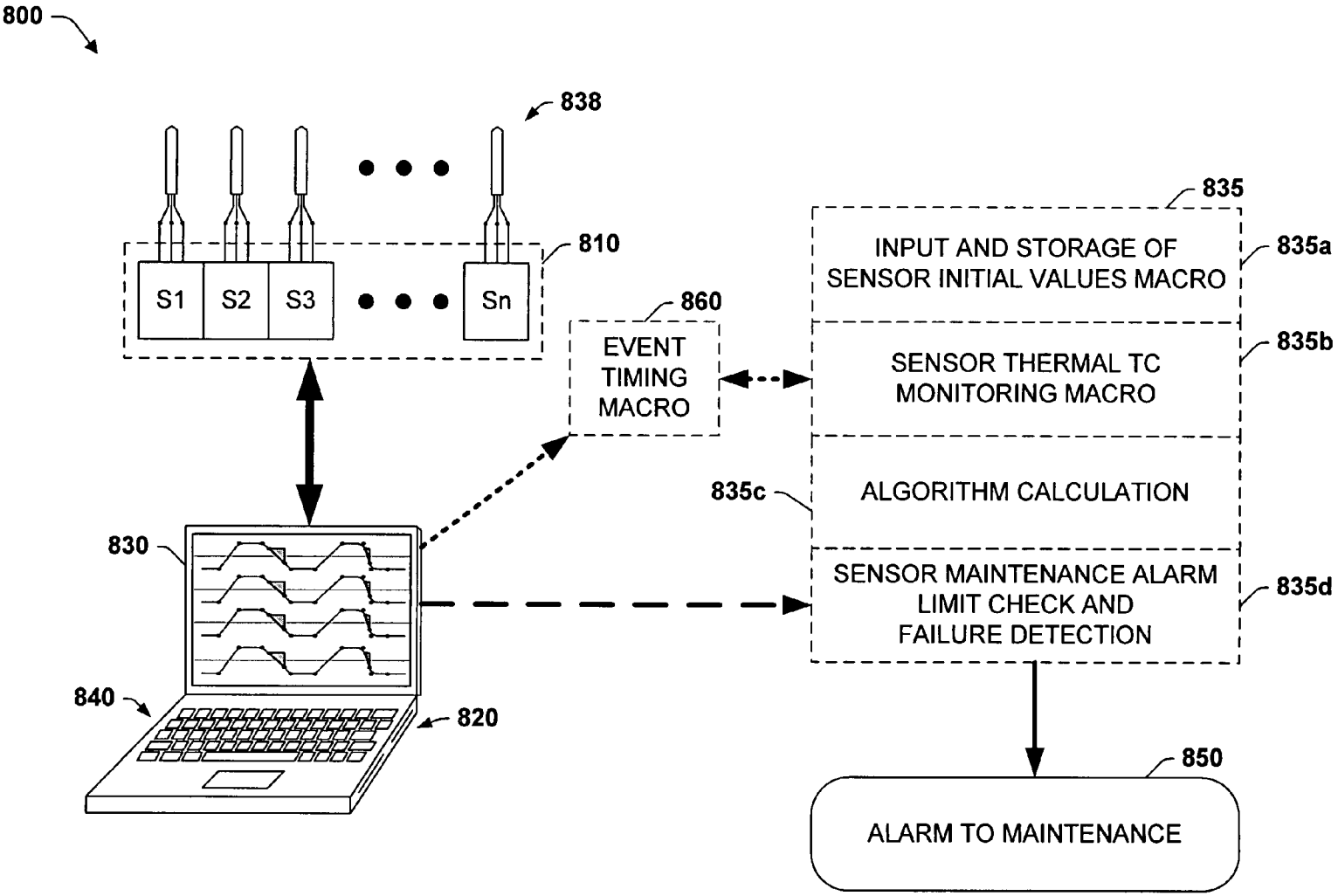
FIG. 8 is a functional diagram of an exemplary fail-safe temperature and presence monitoring system and illustrating a method for monitoring, analyzing, and detecting sensor temperature, medium presence, and predicting sensor or system failures in accordance with an aspect of the present invention.

FIG. 8 illustrates an exemplary fail-safe sensor monitoring system 800 similar to those of FIGS. 6A and 6B, and 7A and 7B, such as may be used in a larger scale HVAC system having, for example, one or more fail-safe sensors or boilers. The fail-safe sensor monitoring system 800 illustrates a method for monitoring, analyzing, and detecting sensor temperature, medium presence, and detecting sensor failures in accordance with an aspect of the present invention.

The present invention provides one such method and system for monitoring one or more sensors and detecting current or impending sensor or HVAC system failures automatically and without disrupting service. A component or medium detection portion of the algorithm of the present invention utilizes a change in the cool-down time constant that exceeds a predetermined level based on the sensor temperature measurements to detect the presence or absence of a component or medium surrounding the sensor. A failure detection portion of the algorithm of the present invention, for example, utilizes a change over time in the warm-up and/or cool-down time constants of the sensor temperature measurements to detect an impending sensor or HVAC system failure. In addition, no change or an extreme change in the warm-up and/or cool-down TC of the sensor temperature measurements may indicate a present sensor or HVAC system failure.

For example, FIG. 8 illustrates one example of a fail-safe sensor monitoring system 800 for monitoring, analyzing, and detecting sensor temperature, medium presence, and predicting sensor or system failures in accordance with an aspect of the present invention. The detection system 800 comprises a temperature measuring component 810, a storage component 820, and an analyzer 830 having an alarm and failure detection algorithm 835 used by the analyzer 830 for calculating sensor thermal time constants and detecting changes in the sensor measurements associated with sensor degradations to make sensor or system failure predictions. The temperature measuring component 810 is operable to monitor one or more fail-safe sensors 838 (e.g., 400, 460) and the resistance of the sensor monitoring circuit, and forward the results to the analyzer 830. The analyzer 830 is operable to receive one or more sensor parametric inputs 840 (e.g., provided by the manufacturer, or otherwise predetermined), and the results of the temperature measuring component 810.

The analyzer 830 of FIG. 8 is further operable to analyze the results of the temperature monitor component 810, and use the algorithm 835 together with the sensor parametric inputs 840 to compute and store the computed, predetermined, acceptable thermal TC levels, and other input parameters to the storage component 820. The analyzer 830 of the detection system 800 is further operable to direct the measurement component to make additional resistance (temperature) measurements of each sensor and to analyze and determine using the alarm and failure detection algorithm 835, a limit check for a sensor maintenance alarm 835*d*. The analyzer 830 is also operable to make a failure prediction 835*d* of the sensor or system, and issue an alarm condition to maintenance 850 if a predetermined acceptable limit has been achieved or exceeded. For example, when a predetermined failure level is reached, maintenance may be alerted to check or replace the sensor, to check for contaminate build-up on the sensor, or alternatively to check for loose terminal connections or broken leadwires.

In another aspect of the present invention, an event timing macro 860 is further added to control how often the sensor thermal TC measurement is made via a sensor thermal TC monitoring macro 835*b*. For example, timings ranging from continuous thermal TC measurements to once per day, or once per thermal process cycle may be enabled with the event timing macro 860.

Another aspect of the invention provides a methodology for monitoring, analyzing, and detecting the temperature and presence of a component or medium in a sensor monitoring system as illustrated and described herein, as well as other types of temperature monitoring systems.

The method relies on a change that exceeds a predetermined level in the cool-down thermal TC as an indicator of the presence or absence of a component or medium surrounding the sensor and of the sensor health. For example, after measurements and calculations, a high slope thermal TC indicates the presence of a medium at the sensor, while a low slope thermal TC indicates the absence of the same medium. However, if no slope or an extremely high slope is detected, a sensor or system failure is likely to be indicated. Optionally, a slope that increases or decreases over time is an indicator of, for example, a sensor or system degradation or an impending failure. The method of the present invention utilizes an algorithm to detect sensor temperature measurements, medium presence, and sensor or system degradations to enable failure predictions as described above.

Figure 9A:
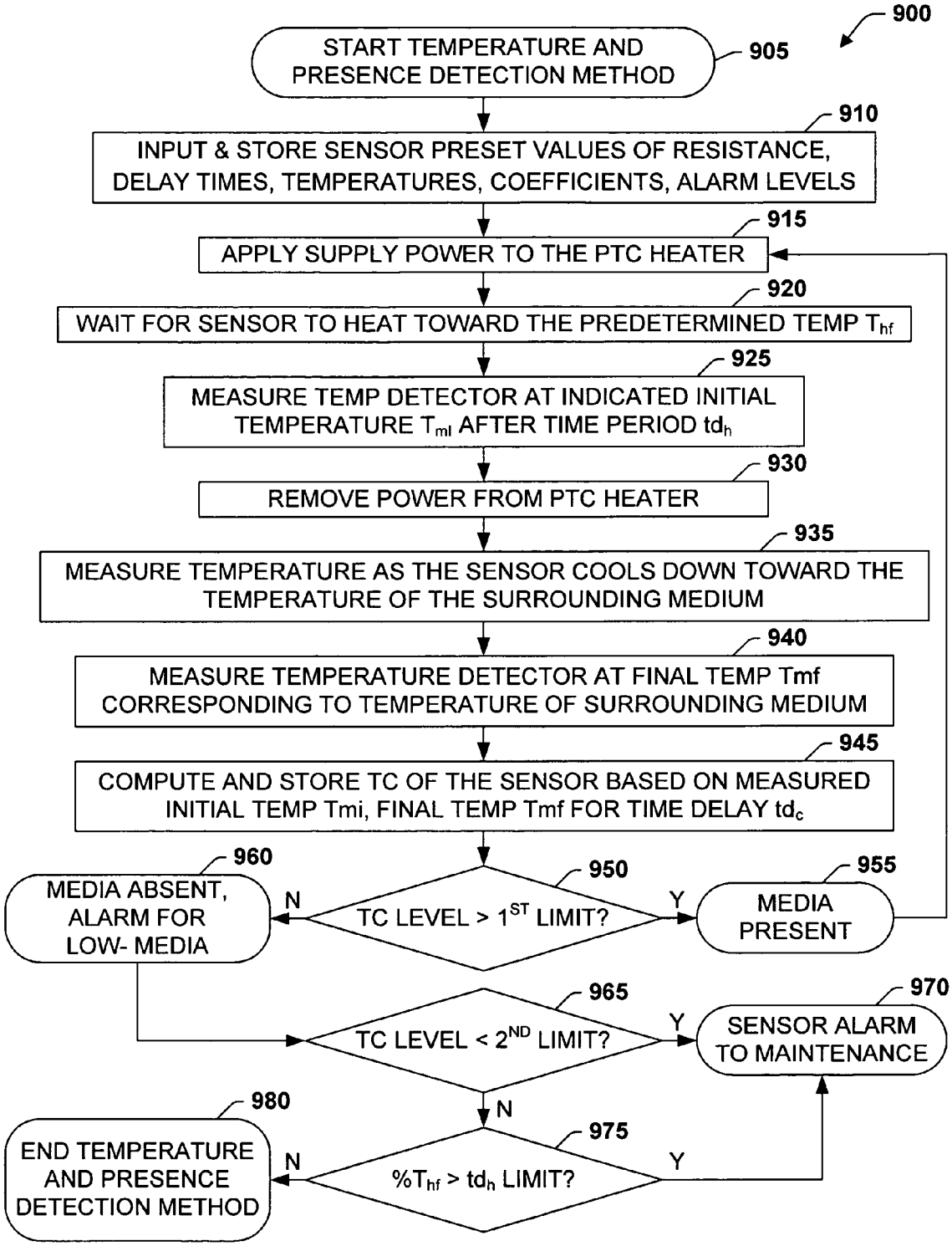
FIGS. 9A and 9B are flow chart diagrams illustrating methods of detecting a temperature and/or a presence of a medium, and predicting failures in a fail-safe temperature and presence monitoring system in accordance with one or more aspects of the present invention.

Referring now to FIG. 9A, an exemplary method 900 is illustrated for monitoring, analyzing, and detecting sensor temperature, medium presence, and sensor failures, for example, in a fail-safe temperature and presence detection system similar to the systems of FIGS. 6A and 6B, 7A and 7B, and 8, in accordance with an aspect of the present invention. Method 900 may also be better understood in association with the thermal plot 1000*a*, and logic timing diagrams 1030 and 1050 of FIG. 10. While the method 900 and other methods herein are illustrated and described below as a series of acts or events, it will be appreciated that the present invention is not limited by the illustrated ordering of such acts or events. For example, some acts may occur in different orders and/or concurrently with other acts or events apart from those illustrated and/or described herein, in accordance with the invention. In addition, not all illustrated steps may be required to implement a methodology in accordance with the present invention. Furthermore, the method 900 according to the present invention may be implemented in association with the detection systems, elements, and devices illustrated and described herein as well as in association with other systems, elements, and devices not illustrated.

The exemplary fail-safe temperature and presence detection method 900 of FIG. 9A begins at 905. Initially (upon installation) at 910, method 900 comprises inputting and storing specific parameters 740 (e.g., the initial resistance $R_{m0}$ of the temperature detector 410 from the sensor manufacturer, or as predetermined acceptable TC levels) of the fail-safe sensor 400/460 (e.g., PTC thermistor). Other parameters 740 input at 910 may also include the known self-regulation temperature $T_{hf}$ of the heater 420, a TC $1^{st}$ level associated with the presence/absence of a medium, a TC $2^{nd}$ level associated with a sensor alarm level for maintenance, and a maximum allowable delay time $td_h$. The input parameters are stored in memory for future use and/or reference. At 915, a power supply voltage 734 is applied to the PTC heater 420 to begin heating the sensor 400/460.

After waiting for a period of time, such as the delay time $td_h$, at 920, the sensor will have heated to about the predetermined self-regulation temperature $T_{hf}$ of the PTC heater 420. At 925, for example, after the delay time $td_h$, the temperature detector 410 is then measured at an initial self-heated temperature $T_{mi}$. Accordingly, after an appropriate warm-up period, the measured temperature $T_{mi}$ indicated by the temperature detector 410 of a healthy sensor will approximate the self regulation temperature $T_{hf}$, or $T_{mi}$~$T_{hf}$. Power supply voltage 734 is then removed from the PTC heater 420 at 930. As the sensor cools down toward the temperature of the surrounding medium (e.g., water, Ammonia, Freon) at 935, the sensor temperature detector 410 is monitored and measurements are taken. Optionally, the initial temperature $T_{mi}$ may be updated again or continuously updated just prior to the thermal cool-down slope measurements, to obtain a fully stabilized measurement $T_{mi}$ of the self-heating temperature $T_{hf}$.

When the temperature stabilizes, at 940, the temperature detector 410 is measured at a final temperature $T_{mf}$, corresponding to the temperature of the surrounding medium (e.g., water, Freon). A thermal cool-down TC slope (slope 1) is then computed and stored at 945 based on the initial temperature $T_{mi}$, the final temperature $T_{mf}$, and elapsed time period $td_c$ between the temperature readings.

The computed TC slope level, slope 1 is then compared to the TC $1^{st}$ level associated with the presence/absence of a medium at 950. If it is determined at 950 that the measured TC level, slope 1 is greater than the TC $1^{st}$ level, indicating that the medium is present at the sensor (e.g., the sensor is immersed in water), then the medium is present at 955 and the algorithm and thermal cycling continues to 915, wherein the PTC heater is again heated for another temperature and presence detection. If, however, at 950 the measured TC level, slope 1 is not greater than the TC $1^{st}$ level, then it is determined that the medium is absent from the sensor, and a low-media alarm is output at 960 (e.g., the sensor is in air, alarm for low-water cut-off), and the algorithm continues to 965.

At 965, the computed TC slope level, slope 1 is then compared to the TC $2^{nd}$ level associated with a sensor low level alarm for maintenance. If it is determined at 965 that the measured TC level, slope 1 is less than the TC $2^{nd}$ level, then an unacceptable sensor TC slope minimum level is indicated and the algorithm outputs a sensor alarm to maintenance at 970. If, however, the measured TC level, slope 1 is not less than the TC $2^{nd}$ level, then the sensor is checked further at 975. For example, if a crack or bubble forms in the sensor potting material between the heater and detector elements, if the sensor has been dislodged, or if the sensor otherwise fails, then the calculated slope may become lower than the acceptable minimum slope level.

At 975, a comparison is made to determine if the sensor (as indicated by the initial temperature measurement $T_{mi}$) was able to heat to within a predetermined percentage of the self regulation temperature $T_{hf}$ within the delay time $td_h$. This comparison indicates the ability of the heater 420 to heat properly to the known temperature, as well as the ability of the temperature detector 410 to accurately report the known temperature of the PTC heater 420. If the predetermined percentage of the self regulation temperature $T_{hf}$ is not achieved within the time delay limit $td_h$, then the algorithm outputs a sensor alarm to maintenance at 970. Otherwise, if the predetermined percentage of the self regulation temperature $T_{hf}$ is successfully achieved by the initial temperature measurement $T_{mi}$ within the time delay limit $td_h$, then the algorithm of method 900 ends at 980, and another heating and cooling thermal cycle of the method may begin again, for example, at 915.

Alternately, at steps 935 and 940 of method 900, as the sensor cools down toward the temperature of the surrounding medium, the sensor temperature detector 410 is monitored and measurements are taken after the initial temperature $T_{mi}$ and before the final temperature $T_{mf}$, wherein such intermediate temperature measurements may be used to compute a thermal cool-down TC slope (slope 1) at 945.

Figure 9B:
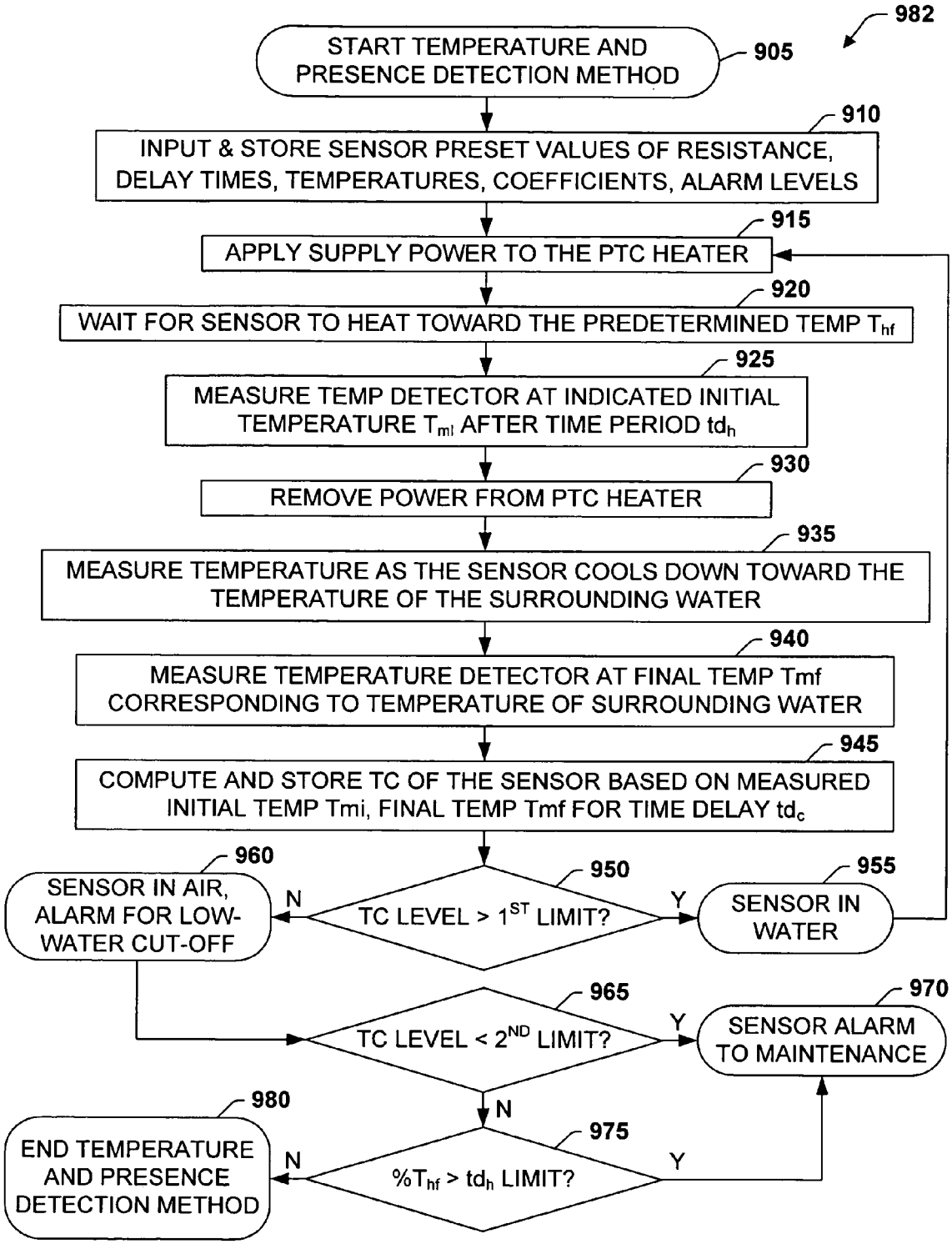

Similarly, the method 982 of FIG. 9B illustrates when water is used as the medium such as in a boiler similar to that of FIG. 5, wherein the TC levels are specifically predetermined to distinguish between a sensor immersed in water (media presence) and a sensor in air above the water (media absent).

In another aspect of the present invention of methods 900 and 982, a time-series history of the initial and final temperatures and/or the calculated thermal TC slopes may be recorded in the storage component 720, 820 for later use. The recorded values may then be used in a trend analysis to anticipate future values based on an acceptable level of sensor or system degradation over time in order to make a failure prediction, or to signal that a failure is imminent.

Figure 10:
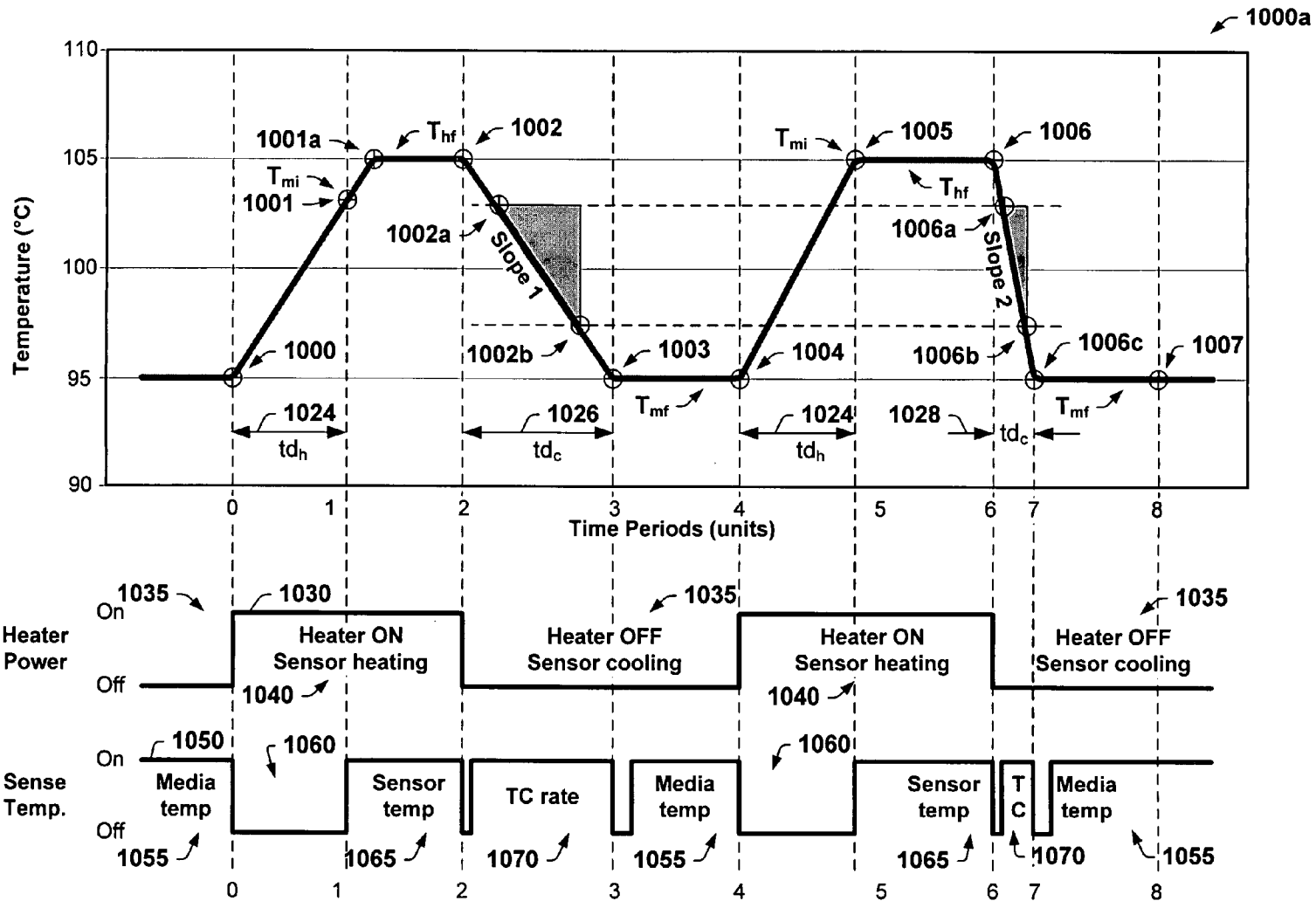
FIG. 10 is a simplified plot of the changes in temperature of the exemplary fail-safe temperature/presence monitoring systems of FIGS. 6A, 6B, 7A, 7B, and 8, a timing diagram plot of the heater on-times, and the temperature detection timing for measuring the medium temperature, the sensor regulation temperature, and the temperature decay rate time constant (TC) used to determine the absence or presence of a component or medium at the sensor as computed by the algorithms of FIGS. 9A and 9B in accordance with the present invention.

FIG. 10 illustrates a simplified plot 1000*a* of the changes in temperature of the exemplary fail-safe temperature/presence monitoring systems of FIGS. 6A, 6B, 7A, 7B, and 8. Plot 1000*a* of FIG. 10, also illustrates the heating and cooling cycles produced by the sensor PTC heater 420 and the resulting temperature decay rates (slope 1 and slope 2) produced as a result of the absence or presence of a component or medium at the sensor using the algorithms and methods 900 and 982 of FIGS. 9A and 9B, respectively in accordance with the present invention.

FIG. 10 further illustrates a timing diagram plot 1030 of the PTC heater 420 on-times required to produce the sensor heating and cooling cycles of plot 1000*a*, and an associated plot 1050 of the temperature detector 410 timing for measuring the sensor temperatures. The sensor temperatures include the medium temperature, the sensor regulation temperature, and the temperatures taken during the thermal cool-down, which may be used to compute the thermal decay rate time constant (TC) or slope. The thermal TC slopes are then used to determine the absence or presence of a component or medium at the sensor 400/460 as computed by the algorithms and methods 900 and 982 of FIGS. 9A and 9B, respectively in accordance with the present invention.

Plot 1000*a* and timing diagrams 1030 and 1050 of FIG. 10, illustrate events which take place at exemplary time periods 0-8. For the present example of FIG. 10, the sensor 400/460 is at a temperature of about 95° C. (about 203° F.) just prior to time period 0 at temperature node 1000. Prior to time period 0, the sensor heater 420 of timing diagram 1030 is off (1035) with respect to the power supply voltage, and the sensor temperature detector 410 of timing diagram 1050 is on and measuring the medium (e.g., water) temperature 1055. In accordance with method 900, heater 420 power 1030 is turned on 1040 at time period 0 at temperature node 1000 and the temperature detector may be turned off 1060 (or otherwise need not be used) while the sensor heats. After a predetermined time period $td_h$, after time period 1, the sensor should be fully heated to the self-regulated temperature $T_{hf}$ of the heater 420 at temperature node 1001, which is about 105° C. (about 221° F.) in the present example.

The sensor temperature detector 410 may be verified 1065 at or after time period 1, by comparing the detector 410 measurement $T_{mi}$ 1065 to that of the known self-regulation temperature $T_{hf}$ of the PTC heater 420. In addition, if a predetermined delay time ($td_h$ 1024) is exceeded (1001 to 1001*a*) during the sensor warm-up before $T_{mi}$ achieves a predetermined percentage of the self-regulation temperature $T_{hf}$, a sensor failure may be indicated. Alternately, a warm-up thermal TC slope may be computed to determine such a possible sensor failure. As power remains on the heater 420, after time period 1, the sensor continues to heat but stays at the self-regulation temperature. At time period 2 the medium presence portion of the method 900 (steps 930 to 960) ensues, wherein a thermal cool-down slope is identified. At time period 2, the heater 420 is turned off 1035 and a last self-regulated temperature $T_{mi}$ measurement 1065 is recorded for future reference at temperature node 1002.

Between time periods 2 and 3, as the sensor cools down toward the temperature of the surrounding medium, the temperature detector 410 is again measured 1070 to determine the thermal decay rate time constant (TC) or slope (slope 1). At time period 3, a final temperature measurement $T_{mf}$ for calculation of the slope 1 (1070) may be taken. The temperature difference between the self-regulation temperature $T_{mi}$ and the final temperature measurement $T_{mf}$ divided by the elapsed time ($td_c$, 1026) between these temperatures may be used for computation of slope 1. Alternately, two or more temperature measurements, such as 1002*a* and 1002*b*, and the elapsed time between the two measurements may be used for computation of slope 1. If the time constant of slope 1 is low as illustrated between time periods 2 and 3, the medium may be absent from contact with the sensor. Between time periods 3 and 4, heater power remains off 1035 and the temperature of the surrounding medium may be measured 1055 with temperature detector 410. This completes one full thermal cycle of the sensor wherein the temperature and presence of the medium is detected.

For example, when a low-water cut-off condition is encountered in a boiler, the medium (water) loses contact with the sensor and the computed slope is lower than a first predetermined TC limit. In such a case, water may be added to the boiler system.

Another thermal cycle of the sensor is illustrated starting at time period 4, wherein heater power is again applied 1040 to heat the sensor to the self-regulation temperature $T_{mi}$ at time period 5, which is about 105° C. (about 221° F.) in the present example. The method continues between time periods 4-8 as described before between time periods 0-4, wherein a sensor verification temperature is taken between time periods 5 and 6, the allowable sensor warm-up time delay is verified ($td_h$

1024), and another TC slope, slope 2 is determined over elapsed time ($td_c$, 1028) between two or more temperature measurements, such as 1006*a* and 1006*b* used for computation of slope 2 for indicating medium presence. In this example, slope 2 illustrates a higher slope rate that is an indication of the presence of the medium at the sensor. For example, if water is now present at the sensor of the boiler example, the TC slope level, slope 2 is higher than the first predetermined TC limit. If however, slope 2 is less than a second predetermined TC slope level, this may be an indication of another possible sensor or system failure condition.

Although the invention has been illustrated and described with respect to one or more implementations, equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising."

What is claimed is:

1. A fail-safe sensor for an HVAC system, comprising:

a temperature detector operable to measure a temperature of a component or a medium;

a PTC heater operable to heat the sensor to a self-regulating temperature, the heater comprising a resistive element having an electrical impedance which increases with increasing temperature in accordance with a positive temperature coefficient characteristic; and a sensor housing comprising the PTC heater and the temperature detector therein;

wherein in a heating mode the sensor is heated to the self-regulating temperature by the PTC heater and the temperature is measured by the temperature detector provides a fail-safe confirmation of temperature detector operation in response thereto, and wherein in a cooling mode the sensor cools to a temperature of the medium or component, and the temperature detector provides temperature data indicative of a time constant of the thermal decay rate of the sensor.

2. The fail-safe sensor of claim 1, wherein the HVAC system comprises a furnace, a boiler, a ventilation system, a refrigeration system, or an air conditioning system.

3. The fail-safe sensor of claim 1, wherein the PTC heater further comprises a first and second terminal for electrical connection thereto; and the temperature detector comprises a first and second terminal for electrical connection thereto;

wherein the first terminals of the PTC heater and the temperature detector are electrically connected together to form a three terminal circuit.

4. The fail-safe sensor of claim 1, wherein the sensor housing further comprises a thermal contact side that permits close thermal contact between the temperature detector and the component or between the temperature detector and the medium, and a dry side that provides connection to electrical terminals of the heater and temperature detector within the sensor housing.

5. The fail-safe sensor of claim 4, wherein the sensor housing further comprises a thermally conductive and electrically insulative material formed about the heater and temperature detector to provide a close thermal union between the heater and temperature detector.

6. The fail-safe sensor of claim 4, wherein the sensor is affixed at a location in the system to provide thermal contact with one of the component, and the medium on the thermal contact side of the sensor housing, wherein the location is representative of a fail-safe operation level of the medium.

7. The fail-safe sensor of claim 4, wherein the sensor is affixed at a low medium level location in the system to provide thermal contact with the medium on the thermal contact side of the sensor housing, wherein the location is representative of a fail-safe operation level of the medium.

8. The fail-safe sensor of claim 7, wherein the medium is water, and the low medium level location is a low-water level location representative of a fail-safe operation level of the water in a boiler system.

9. The fail-safe sensor of claim 7, wherein the component or medium measured by the sensor is one of a heat exchanger, an outlet plenum, an air stream, a chamber wall, and a stack of a furnace system.

10. The fail-safe sensor of claim 1, wherein the temperature detector comprises at least one of a PTC thermistor, an NTC thermistor, a platinum resistance wire element, a thermocouple, and an integrated circuit temperature detector.

11. The fail-safe sensor of claim 1, wherein the PTC heater comprises one of a PTC thermistor and an integrated circuit heater operable to heat and self regulate the sensor at a self-regulating temperature that is measured and confirmed by the temperature detector, thereby providing fail-safe operation of the sensor.

12. The fail-safe sensor of claim 11, wherein the integrated circuit heater is further operable to digitally communicate to an analyzer one or more of a temperature signal generated by the sensor, a sensor parametric input, a sensor model, a sensor serial number, a manufacturing date, and a calibration temperature.

13. The fail-safe sensor of claim 1, wherein the PTC heater and the temperature detector are pre-fabricated together on a single integrated circuit die operable to heat and self regulate the sensor to a self-regulating temperature that is measured and confirmed by the temperature detector, thereby providing fail-safe operation of the sensor.

14. The fail-safe sensor of claim 1, wherein the presence or absence of medium surrounding the sensor may be determined by calculating the time constant of the thermal decay rate of the sensor upon cooling from a predetermined heater temperature as measured by the temperature detector.

15. The fail-safe sensor of claim 1, further comprising an analyzer that interprets thermal decay data wherein the presence or absence of the component or medium at the sensor may be determined in a fail-safe manner by calculating the time constant of the thermal decay rate of the sensor upon cooling from the self-regulating temperature as measured by the sensor temperature detector.

16. The fail-safe sensor of claim 1, further comprising:

a memory storage component; and an analyzer operably coupled to one or more fail-safe sensors and the storage component, the analyzer having a temperature and presence detection algorithm used by the analyzer to detect the temperature and presence of a medium in contact with respective sensors and to detect sensor failures;

wherein temperature signals generated by respective sensors are provided to the analyzer and utilized within the temperature and presence detection algorithm by the analyzer to generate a sensor temperature and a sensor thermal time constant computation, the level of which provides one of an indication of a low-medium alarm, and a sensor alarm.

17. The fail-safe sensor of claim 16, wherein the analyzer is operable to measure the resistance of the one or more sensors to provide the temperature signals.

18. The fail-safe sensor of claim 16, wherein the analyzer is operable to receive one or more sensor parametric inputs provided by the manufacturer, and a self-heating temperature of the sensor.

19. The fail-safe sensor of claim 18, wherein respective sensors are further operable to digitally communicate to the analyzer one or more of the temperature signals, a sensor parametric input, a sensor model, a sensor serial number, a manufacturing date, and a calibration temperature.

20. The fail-safe sensor of claim 18, wherein the analyzer is further operable to analyze the temperature signals from the respective sensors, and use the algorithm together with the sensor parametric inputs to compute and store the thermal time constant value to the memory storage component.

21. The fail-safe sensor of claim 20, wherein the analyzer is further operable to generate a time-series history of the sensor thermal time constant computations and the temperature signals or resistance measurements of each sensor and to analyze and determine using the detection algorithm, a failure prediction of the sensor, and issue an alarm condition if a predetermined limit has been achieved.

22. The temperature and presence detection algorithm of claim 16, wherein the sensor temperature detection generated by the algorithm is based on a measurement of the sensor resistance.

23. The fail-safe sensor of claim 16, wherein the algorithm is performed by the analyzer and conveyed by a computer readable media.

24. A fail-safe sensor for detecting water temperature and the presence of water in a water boiler, wherein the sensor comprises a PTC heater and a temperature detector provided in a single housing;

the PTC heater comprising a resistive element having an electrical impedance which increases with increasing temperature in accordance with a positive temperature coefficient characteristic;

wherein the sensor is located at a low water cut-off level location in the boiler for immersion by the water on a wet side of the sensor housing, and wherein a controller is connected to electrical terminals of the heater and temperature detector on a dry side of the sensor housing; and wherein the PTC heater is operable in a heating mode to bring the sensor to a self-regulating temperature that is measured by the temperature detector to confirm a fail-safe temperature thereof in response thereto, and wherein the sensor in a cooling mode cools to the temperature of the medium and wherein the temperature detector senses the temperature of the medium, and wherein the controller calculates the time constant of the thermal decay rate of the sensor, and determines the presence of a water or air medium.

25. The fail-safe sensor of claim 24, wherein the PTC heater further comprises a first and second terminal for electrical connection thereto; and the temperature detector comprises a first and second terminal for electrical connection thereto;

wherein the first terminals of the PTC heater and the temperature detector are electrically connected together to form a three terminal circuit.

26. The fail-safe sensor of claim 24, wherein the sensor housing further comprises a thermally conductive and electrically insulative material formed about the heater and temperature detector to provide a close thermal union between the heater and temperature detector.

27. The fail-safe sensor of claim 24, wherein the low-water level location is representative of a fail-safe operation level of the water in the boiler system.

28. The fail-safe sensor of claim 24, wherein the temperature detector comprises at least one of a PTC thermistor, an NTC thermistor, a platinum resistance wire element, a thermocouple, and an integrated circuit temperature detector.

29. The fail-safe sensor of claim 24, wherein the PTC heater comprises one of a PTC thermistor and an integrated circuit heater operable to heat and self regulate the sensor at a self-regulating temperature that is measured and confirmed by the temperature detector, thereby providing fail-safe operation of the sensor and the boiler.

30. The fail-safe sensor of claim 29, wherein the integrated circuit heater is further operable to digitally communicate to an analyzer one or more of a temperature signal generated by the sensor, a sensor parametric input, a sensor model, a sensor serial number, a manufacturing date, and a calibration temperature.

31. The fail-safe sensor of claim 24, wherein the PTC heater and the temperature detector are pre-fabricated together on a single integrated circuit die operable to heat and self regulate the sensor to a self-regulating temperature that is measured and confirmed by the temperature detector, thereby providing fail-safe operation of the sensor and the boiler.

32. The fail-safe sensor of claim 24, further comprising an analyzer that interprets thermal decay data wherein the presence or absence of the component or medium at the sensor may be determined in a fail-safe manner by calculating the time constant of the thermal decay rate of the sensor upon cooling from the self-regulating temperature as measured by the sensor temperature detector.

33. The fail-safe sensor of claim 24, further comprising:

a memory storage component; and an analyzer operably coupled to one or more fail-safe sensors and the storage component, the analyzer having a temperature and presence detection algorithm used by the analyzer to detect the temperature and presence of a medium in contact with respective sensors and to detect sensor failures;

wherein temperature signals generated by respective sensors are provided to the analyzer and utilized within the temperature and presence detection algorithm by the analyzer to generate a sensor temperature and a sensor thermal time constant computation, the level of which provides one of an indication of a low-medium alarm, and a sensor alarm.

34. The fail-safe sensor of claim 33, wherein the analyzer is operable to measure the resistance of the one or more sensors to provide the temperature signals.

35. The fail-safe sensor of claim 33, wherein the analyzer is operable to receive one or more sensor parametric inputs provided by the manufacturer, and a self-heating temperature of the sensor.

36. The fail-safe sensor of claim 35, wherein respective sensors are further operable to digitally communicate to the analyzer one or more of the temperature signals, a sensor parametric input, a sensor model, a sensor serial number, a manufacturing date, and a calibration temperature.

37. The fail-safe sensor of claim 35, wherein the analyzer is further operable to analyze the temperature signals from the respective sensors, and use the algorithm together with the sensor parametric inputs to compute and store the thermal time constant value to the memory storage component.

38. The fail-safe sensor of claim 37, wherein the analyzer is further operable to generate a time-series history of the sensor thermal time constant computations and the temperature signals or resistance measurements of each sensor and to analyze and determine using the detection algorithm, a failure prediction of the sensor, and issue an alarm condition if a predetermined limit has been achieved.

39. The temperature and presence detection algorithm of claim 33, wherein the sensor temperature detection generated by the algorithm is based on a measurement of the sensor resistance.

40. The fail-safe sensor of claim 33, wherein the algorithm is performed by the analyzer and conveyed by a computer readable media.

41. A fail-safe sensor for an HVAC system, comprising:

a PTC device in a sensor housing operable to heat the sensor to a self-regulating temperature and to measure a temperature of a component or a medium, the PTC device comprising a resistive element having an electrical impedance which increases with increasing temperature in accordance with a positive temperature coefficient characteristic; and wherein in a heating mode the sensor is heated to the self-regulating temperature by applying a voltage to the PTC device and the temperature associated with a resistance of the PTC device is measured thereat and provides a fail-safe confirmation of the sensor, and wherein in a cooling mode the sensor cools to a temperature of the medium or component, and the resistance of the PTC device provides temperature data indicative of a time constant of the thermal decay rate of the sensor.

42. The fail-safe sensor of claim 41, wherein the HVAC system is one of a furnace, a boiler, a ventilation system, a refrigeration system, and an air conditioning system.

43. The fail-safe sensor of claim 41, wherein the sensor housing further comprises a thermal contact side that permits close thermal contact between the PTC device and the component or between the PTC device and the medium, and a dry side that provides connection to electrical terminals of the sensor.

44. The fail-safe sensor of claim 43, wherein the sensor housing further comprises a thermally conductive and electrically insulative material formed about the PTC device to provide a close thermal union between the PTC device and the component or medium surrounding the sensor.

45. The fail-safe sensor of claim 43, wherein the sensor is affixed at a location in the system to provide thermal contact with one of the component, and the medium on the thermal contact side of the sensor housing, wherein the location is representative of a fail-safe operation level of the medium.

46. The fail-safe sensor of claim 43, wherein the sensor is affixed at a low medium level location in the system to provide thermal contact with the medium on the thermal contact side of the sensor housing, wherein the location is representative of a fail-safe operation level of the medium.

47. The fail-safe sensor of claim 46, wherein the medium is water, and the low medium level location is a low-water level location representative of a fail-safe operation level of the water in a boiler system.

48. The fail-safe sensor of claim 46, wherein the component or medium measured by the sensor is one of a heat exchanger, an outlet plenum, an air stream, a chamber wall, and a stack of a furnace system.

49. The fail-safe sensor of claim 41, wherein the PTC device comprises one of a PTC thermistor and an integrated circuit heater operable to heat and self regulate the sensor at a self-regulating temperature that is measured and confirmed by monitoring the resistance of the PTC device or the current and voltage on the PTC device, thereby providing fail-safe operation of the sensor and the HVAC system.

50. The fail-safe sensor of claim 41, wherein the PTC device is pre-fabricated on a single integrated circuit die operable to heat and self regulate the sensor to a self-regulating temperature that is measured and confirmed by a temperature detector within the integrated circuit, thereby providing fail-safe operation of the sensor.

51. The fail-safe sensor of claim 41, wherein the presence or absence of medium surrounding the sensor may be determined by calculating the time constant of the thermal decay rate of the sensor upon cooling from a self-regulating temperature as measured by the PTC device.

52. The fail-safe sensor of claim 41, further comprising an analyzer that interprets thermal decay data wherein the presence or absence of the component or medium at the sensor may be determined in a fail-safe manner by calculating the time constant of the thermal decay rate of the sensor upon cooling from the self-regulating temperature as measured by the sensor temperature detector.

53. The fail-safe sensor of claim 41, further comprising:

a memory storage component; and an analyzer operably coupled to one or more fail-safe sensors and the storage component, the analyzer having a temperature and presence detection algorithm used by the analyzer to detect the temperature and presence of a medium in contact with respective sensors and to detect sensor failures;

wherein temperature signals generated by respective sensors are provided to the analyzer and utilized within the temperature and presence detection algorithm by the analyzer to generate a sensor temperature and a sensor thermal time constant computation, the level of which provides one of an indication of a low-medium alarm, and a sensor alarm.

54. The fail-safe sensor of claim 53, wherein the analyzer is operable to measure the resistance of the one or more sensors to provide the temperature signals.

55. The fail-safe sensor of claim 53, wherein the analyzer is operable to receive one or more sensor parametric inputs provided by the manufacturer, and a self-heating temperature of the sensor.

56. The fail-safe sensor of claim 55, wherein respective sensors are further operable to digitally communicate to the analyzer one or more of the temperature signals, a sensor parametric input, a sensor model, a sensor serial number, a manufacturing date, and a calibration temperature.

57. The fail-safe sensor of claim 55, wherein the analyzer is further operable to analyze the temperature signals from the respective sensors, and use the algorithm together with the sensor parametric inputs to compute and store the thermal time constant value to the memory storage component.

58. The fail-safe sensor of claim 57, wherein the analyzer is further operable to generate a time-series history of the sensor thermal time constant computations and the temperature signals or resistance measurements of each sensor and to analyze and determine using the detection algorithm, a failure prediction of the sensor, and issue an alarm condition if a predetermined limit has been achieved.

59. The temperature and presence detection algorithm of claim 53, wherein the sensor temperature detection generated by the algorithm is based on a measurement of the sensor resistance.

60. The fail-safe sensor of claim 53, wherein the algorithm is performed by the analyzer and conveyed by a computer readable media.

* * * * *